US005135152A

United States Patent [19]

Uno et al.

[11] Patent Number: 5,135,152

[45] Date of Patent: Aug. 4, 1992

[54] PNEUMATIC FASTENER DRIVING TOOL

[75] Inventors: Akira Uno, Hitachiohta; Isamu Tanji; Kaoru Ichikawa, both of Katsuta; Sueji Tachihara, Hitachiohta, all of Japan

[73] Assignee: Hitachi Koki Company, Limited, Tokyo, Japan

[21] Appl. No.: 447,495

[22] Filed: Dec. 7, 1989

[30] Foreign Application Priority Data

| | | | |
|---|---|---|---|
| Dec. 9, 1988 | [JP] | Japan | 63-160642[U] |
| Dec. 23, 1988 | [JP] | Japan | 63-327399 |
| Dec. 23, 1988 | [JP] | Japan | 63-327400 |
| Dec. 23, 1988 | [JP] | Japan | 63-327402 |
| Feb. 3, 1989 | [JP] | Japan | 1-25361 |
| Apr. 3, 1989 | [JP] | Japan | 1-39377[U] |
| Apr. 3, 1989 | [JP] | Japan | 1-39379[U] |
| Apr. 3, 1989 | [JP] | Japan | 1-39380[U] |

[51] Int. Cl.[5] ..... B25C 1/04

[52] U.S. Cl. ..... 227/116; 227/130

[58] Field of Search ..... 227/115, 116, 130

[56] References Cited

U.S. PATENT DOCUMENTS

| | | | |
|---|---|---|---|
| 3,567,098 | 3/1971 | Maynard | 227/5 |
| 4,149,297 | 4/1979 | Monacelli | 227/136 |
| 4,344,555 | 8/1982 | Wolfberg | 227/130 |
| 4,436,237 | 3/1984 | Vornberger et al. | 227/130 |
| 4,784,308 | 11/1988 | Novak et al. | 227/130 |

FOREIGN PATENT DOCUMENTS

| | | |
|---|---|---|
| 2741610A1 | 9/1977 | Fed. Rep. of Germany . |
| 3132451A1 | 8/1981 | Fed. Rep. of Germany . |
| 3222949C2 | 6/1982 | Fed. Rep. of Germany . |
| 61-117074 | 6/1986 | Japan . |

*Primary Examiner*—Frank T. Yost
*Assistant Examiner*—John M. Husar
*Attorney, Agent, or Firm*—Lowe, Price, LeBlanc & Becker

[57] ABSTRACT

A pneumatic fastener driving tool includes a main valve operable to cause compressed air to be alternately introduced into and discharged from the upper piston chamber, a first passage leading the compressed air into the main valve chamber, a repeat valve disposed in the first passage for opening and closing the same, and a second passage extending between the lower piston chamber and a repeat valve chamber in which the repeat valve is reciprocably received. With this construction, the repeat valve is reciprocally movable in response to a change of pressure in the lower piston chamber to cause the main valve to reciprocate, thereby reciprocating the piston repeatedly. Since the reciprocating fastener driving movement of the piston is directly related to the reciprocating movement of the repeat valve, the fastener driving work can be achieved reliably without causing any operational failure such as a non-load striking.

21 Claims, 25 Drawing Sheets

PNEUMATIC FASTENER DRIVING TOOL

BACKGROUND OF THE INVENTION

1. Field of the Invention

The present invention relates to a pneumatic fastener driving tool for driving fasteners such as nails, staples or the like into work pieces.

2. Description of the Prior Art

A typical pneumatic fastener driving tool of the type concerned is disclosed in Japanese Patent Laid-open Publication No. 61-117074. The disclosed fastener driving tool includes, as reillustrated here in FIG. 28 of the accompanying drawings, a tool body 1 having a push lever 2 adapted to be forced against a work piece 3 before a trigger 4 is actuated. Upon actuation of the trigger 4, a main valve 5 operates to move a main piston 6 forwardly (downward in the same figure) to thereby drive the leading fastener 7 to the work piece 3. Then an actuator 9 of a feed valve 8 disposed rearwardly (upward in the same figure) of the main valve 5 is pushed by the user's finger to move a feed valve element 10 in a direction to open the feed valve 8 whereupon compressed air stored in an accumulator 11 is allowed to flow through a passage 12 and acts on a feed piston 13 of a fastener supply unit 14, thereby driving the fastener supply unit 14 to feed the next following fastener 7 to a barrel 15 of the fastener driving tool.

Since the actuator 9 of the feed valve 8 is disposed remotely from the trigger 4, it is difficult for the user to operate the thus disposed actuator 9 with a finger of a hand while gripping a handle 16 with the same hand. To feed the fasteners 7 one at a time to the barrel 15, the user must operate the actuator 9 with the other hand. Such fastener feeding operation is tedious and time-consuming and hence considerably lowers the fastener driving efficiency. Furthermore, the conventional fastener driving tool is difficult to operate with a single hand and hence is not suited for a horizontal or an overhead fastener driving work in which one hand of the user is occupied in holding a work piece in a desired position. Thus the working position of the conventional fastener driving tool is substantially limited to a flat position.

The conventional fastener driving tool shown in FIG. 28 has another drawback resulting from the construction and arrangement of the fastener supply unit 14, as described below. The fastener supply unit 14 includes a feed prong 17 connected to the feed piston 13 and driven by the feed piston 13 to reciprocate in a direction perpendicular to the axis of the barrel 15 so as to feed the fasteners 7 one at a time to the barrel 15. The feed piston 13 is normally urged by a return spring 18 in a direction such as to move the feed prong 17 toward the barrel 15. Upon operation of the actuator 9, the fastener supply unit 14 is operative regardless of the movement of the main piston 6. This arrangement is advantageous in that a single fastener can be struck several times by repeating a reciprocating movement of the main piston 6. However, a problem arises when the actuator 9 is inadvertently pushed when a fastener 7 is still present in the barrel 15. In this instance, the feed piston 13 is retracted by the compressed air against the force of the return spring 18 until the feed prong 17 engages the second leading fastener 7. When the actuator 9 is released, the valve element 10 of the feed valve 8 is shifted in a direction to block fluid communication between the accumulator 11 and the feed piston 13 and, at the same time, allow the compressed air to escape from the passage 12 through the feed valve 8 to the atmosphere. The feed prong 17 is urged forwardly by the force of the return spring 18 acting on the feed piston 13, however, advancing movement of the feed prong 17 does not take place because the fastener 7 already existing at an inlet of the barrel 15 prevents the leading fastener 7 from moving into the barrel 15. The inlet of the barrel 15 is cleared out when the fastener 7 loaded therein is driven by the reciprocating movement of the main piston 6 whereupon the leading fastener 7 is automatically loaded in the barrel 15 by the spring-loaded feed prong 17 before the next blow of the main piston 6 is applied to the once-struck fastener 7. With this double loading of the fasteners 7, the second loaded fastener is driven onto the first-loaded fastener 7 In this instance, the second-loaded fastener 7 is likely to fly out from the barrel 15 and may hurt the user. The possibility of such harmful double loading of the fasteners is enhanced when the fastener driving tool is provided with an automatic repeated striking mechanism having a repeat valve which enables automatic repeated reciprocation of the main piston 6 so long as the trigger 4 is actuated.

A typical example of the automatic repeated striking mechanism is disclosed in Japanese Patent Publication No. 57-36114. The disclosed automatic repeated striking mechanism includes, as reillustrated here in FIG. 29, a main valve 20 slidably disposed in a main valve chamber 21. When a trigger (not shown but similar to the trigger 4 shown in FIG. 28) is actuated, compressed air is discharged from the main valve chamber 21 through a first passage 22 to the atmosphere whereupon the main valve 20 is displaced upwardly. With this upward movement of the main valve 20, the compressed air rapidly flows from a striking air chamber or accumulator 24 into an upper piston chamber 23, thereby thrusting a piston 25 downwardly to drive a fastener (not shown) to a work piece. The upward movement of the main valve 20 further causes a changeover valve 26 to shift or change its valve position whereupon the compressed air flows from the accumulator 24 through a second passage 27 into a repeat valve chamber 28 to move a repeat valve 29 downward, thereby interrupting or closing the first passage 22. Then, the compressed air flowing from a third passage 30 into the main valve chamber 21 increases the pressure in the main valve chamber 21 whereupon the main valve 20 is lowered to open a discharge valve 31 to thereby discharge the compressed air from the upper piston chamber 23. Since a lower piston chamber 32 and a return air chamber 33 retain therein the compressed air which is supplied during downward movement of the piston 25, the piston 25 is displaced toward its uppermost position as the compressed air is discharged from the upper piston chamber 23. The downward movement of the main valve 20 causes the changeover valve 26 to shift or change its valve position to discharge the compressed air from the repeat valve chamber 28 through the second passage 27 and through an adjustable throttling valve 34. Thus, the repeat valve 29 moves upwardly to open the first passage 22, thereby discharging the compressed air from the main valve chamber 21. Since the cross-sectional area of the first passage 22 is larger than the cross-sectional area of the third passage 30, the main valve 20 again moves upwardly so that the fastener striking operation by the piston 25 is repeated. Reference numeral 35 denotes a body of the fastener driving tool, 36 a cylinder in which the piston 25 reciprocates, 37 a discharge hole, and 38 an adjustment screw associated with the throttling valve 34 for adjusting the repetition cycle time.

With this construction, while the non-illustrated trigger is being actuated, the main valve 20 and the repeat valve 28 operate alternately to intake the compressed air into the upper piston chamber 23 and subsequently discharge the compressed air from the upper piston chamber 23, so that the reciprocating fastener driving movement of the piston 25 is automatically repeated.

The conventional automatic repeated striking mechanism of the foregoing construction is not satisfactory for the reasons described below. The repeat valve 29 is reciprocated by the compressed air which is introduced into and discharged from the repeat valve chamber 28 in response to reciprocating movement of the main valve 20. Thus, the movement of the repeat valve 29 is not directly related to the movement of the piston 26. Accordingly, when the pressure of the compressed air is relatively low or when the fastener driving tool is operating at a relatively short repetition cycle time, the repeat valve 29 is operated to commence a next fastener striking movement of the piston 25 before the return stroke of the piston 25 is completed. With this incomplete return stroke of the piston 25, a complete driving of the fastener is difficult to achieve. Furthermore, the next fastener cannot be supplied because the fastener supplying operation is timed with the fastener striking movement of the piston 25.

Another drawback associated with the conventional automatic repeated striking mechanism is as follows. The compressed air is discharged from the upper piston chamber 23 as the main valve 20 is lowered. In this instance, the discharge valve 31 is opened before the upper end of the cylinder 36 is closed. Accordingly, an excess amount of compressed air is discharged from the accumulator 24 which is held in communication with the upper piston chamber 23 until the upper end of the cylinder 36 is closed. In order to reduce the amount of discharged compressed air, the main valve 20 must be lowered as fast as possible by, for example, increasing the amount of the compressed air taken into the main valve chamber 21. However, partly because the intake of the compressed air to the main valve chamber 21 is achieved solely through the third passage 30, and partly because the third passage 30 is continuously held in fluid communication with the main valve chamber 21 and the accumulator 24, if the cross-sectional area of the third passage 30 is increased, a large amount of compressed air will be discharged through the third passage 30 during the discharge stroke of the main valve chamber 21 and, therefore, a pressure drop large enough to operate the main valve 20 will not be created in the main valve chamber 21. Thus, the third passage 30 of the conventional automatic repeated striking mechanism cannot be enlarged in its cross section and hence an excessively large amount of compressed air is consumed.

SUMMARY OF THE INVENTION

With the foregoing drawbacks of the prior art in view, it is the primary object of the present invention to provide a pneumatic fastener driving tool which is easy to handle, can be used with safety, and is highly reliable in operation.

A more specific object of the present invention is to provide a pneumatic fastener driving tool including an automatic repeated striking mechanism which is capable of operating reliably even when the fastener driving tool is powered with a relatively low pneumatic pressure or is operating at a relatively short repetition cycle time.

Another object of the present invention is to provide a pneumatic fastener driving tool including an automatic repeated striking mechanism which is operative without undue consumption of compressed air.

A further object of the present invention is to provide a pneumatic fastener driving tool incorporating structural features which enable the user to operate the fastener driving tool with one hand regardless of the fastener driving position.

A still further object of the present invention is to provide a fastener driving tool including a fastener supply unit which is interlocked with a fastener driving unit in such a manner as to avoid accidental double loading of fasteners into a barrel.

According to the present invention, there is provided a pneumatic fastener driving tool comprising: a tool body having an internal accumulator for storing compressed air and a barrel along which a fastener is driven; a cylinder disposed in the tool body and extending in alignment with said barrel; a drive piston assembly including a piston slidably received in the cylinder, and a driving rod extending perpendicularly from the center of the piston and slidably received in the barrel, the cylinder and the piston jointly defining upper and lower piston chambers on opposite sides of the piston; a main valve chamber defined in the tool body and slidably holding therein a main valve, the main valve being externally operable for causing the compressed air to be alternately introduced from the accumulator into the upper piston chamber and discharged from the main valve chamber to the outside air; a first passage defined in the tool body and extending between the accumulator and the main valve chamber for leading the compressed air into the main valve chamber, the piston being driven to reciprocate the driving rod when the compressed air is discharged from the main valve chamber via the first passage; a trigger mounted on the tool body and manually actuable for controlling operation of the main valve; a repeat valve disposed in the first passage for opening and closing the same; a second passage defined in the tool body and extending between the lower piston chamber and a repeat valve chamber in which the repeat valve is reciprocably received, the repeat valve being reciprocally movable in response to a change of pressure in the lower piston chamber to cause the main valve to reciprocate, thereby reciprocating the piston repeatedly; and a fastener supply unit mounted on the tool body for feeding fasteners one at a time to the barrel.

With this arrangement, the reciprocating fastener driving movement of the piston is directly related to the reciprocating movement of the repeat valve. Consequently, the fastener driving operation can be achieved reliably without causing striking failure such as non-load striking.

According to a preferred embodiment, there is provided a connecting passage extending between the main valve chamber and the accumulator and adapted to be opened and closed in response to the reciprocating movement of the main valve, the connecting passage being closed when the main valve is disposed in its bottom dead center.

With the connecting passage thus provided, a waste of the compressed air is considerably reduced and hence the consumption of the compressed air is relatively small.

According to another preferred embodiment, the fastener supply unit includes a feed valve for controlling the operation of the fastener supply unit, and an actuator manually operable from the outside of the tool body to control the operation of the feed valve, the actuator being disposed adjacent to the trigger and manually operable with a finger of the user's hand while gripping a tool handle with the same hand.

The actuator thus arranged enables the user to manipulate the fastener driving tool with a single hand. The fastener driving tool can be used with utmost ease regardless of the fastener driving position.

The fastener supply unit may have a compressed air supply passage extending from the fastener supply unit to the first passage and communicating with a control valve which is disposed in the first passage and adapted to be actuated by the trigger for controlling the operation of the main valve. The feed valve is disposed in the compressed air supply passage.

With this arrangement, so long as the control valve is actuated by the trigger, the compressed air does not flow into the fastener supply unit even when the feed valve is actuated. Accordingly, a harmful double loading of the fasteners to the barrel can be avoided.

When the fastener driving tool is used with a fastener strip which includes a continuous feed belt having a plurality of guide holes longitudinally spaced at equal intervals, and a succession of laterally spaced fasteners supported on the feed belt at equal intervals, the fastener supply unit may include a guide groove extending perpendicularly across the barrel for the passage of the feed belt, a feed piston disposed parallel to the guide groove and reciprocally movable under the control of the feed valve between an advanced position adjacent to the barrel and a retracted position remote from the barrel, the feed piston being normally urged to the retracted position, and a feed prong engageable with one of the guide holes and driven by the feed piston to advance the fastener strip for feeding the leading fastener to the barrel.

With the thus-urged feed prong, it is possible to prevent a double loading of the fasteners to the barrel which would otherwise result in a flying out of a second-loaded fastener from the fastener driving tool.

According to a preferred embodiment, the feed prong normally projects into the guide groove and is retractable from the guide groove as the feed piston moves from the advanced position to the retracted position. The feed prong has an inclined rear surface frictionally engageable with an edge of the guide hole to cause the feed prong to retract away from the guide groove.

With this retractable feed prong the fastener strip can be fed smoothly without causing deformation or bending; if not so done, a deformed fastener strip would jam the guide groove.

The feed piston and the feed prong may be relatively movable in a direction parallel to the axis of the guide groove, in which instance a spring is disposed between the feed piston and the feed prong.

With this arrangement, when the feed piston is driven toward the barrel without regard for the presence of a fastener in the barrel, the feed piston is displaced toward the barrel against the force of the spring while a the same time the feed prong is remain immovable. Consequently, a harmful double loading of the fasteners can be avoided.

According to a preferred embodiment, the piston is formed of light rigid material such as light alloy, synthetic resin or rigid synthetic rubber, and the driving rod is made of metal and has an axial blind hole extending from one end of the driving rod which is connected to the piston.

Thus, the overall weight of the driving piston assembly is substantially reduced. With this weight reduction, the reaction of the operating fastener driving tool is reduced as the magnitude of the reaction is nearly direct proportional to the weight of the driving piston assembly.

The above and other objects, features and advantages of the present invention will become more apparent from the following description when making reference to the detailed description and the accompanying sheets of drawings in which preferred structural embodiments incorporating the principles of the present invention are shown by way of illustrative examples.

DETAILED DESCRIPTION OF THE PREFERRED EMBODIMENTS

Figure 1:
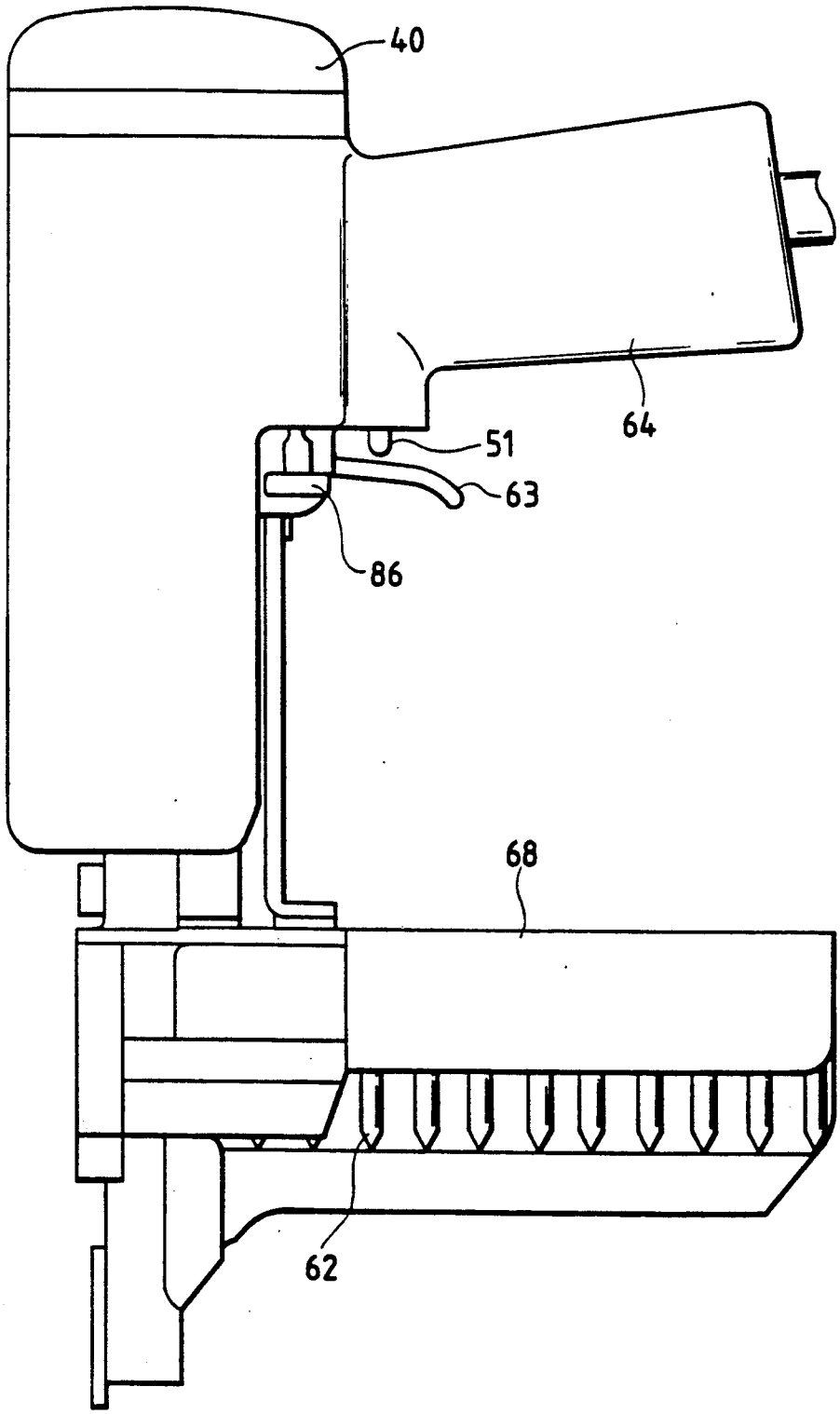
FIG. 1 is a front elevational view of a pneumatic fastener driving tool according to the present invention.

Referring now to the drawings, wherein like reference characters designate like or corresponding parts throughout the several views, and more particularly to FIG. 1, there is shown a pneumatic fastener driving tool according to the present invention.

Figure 2:
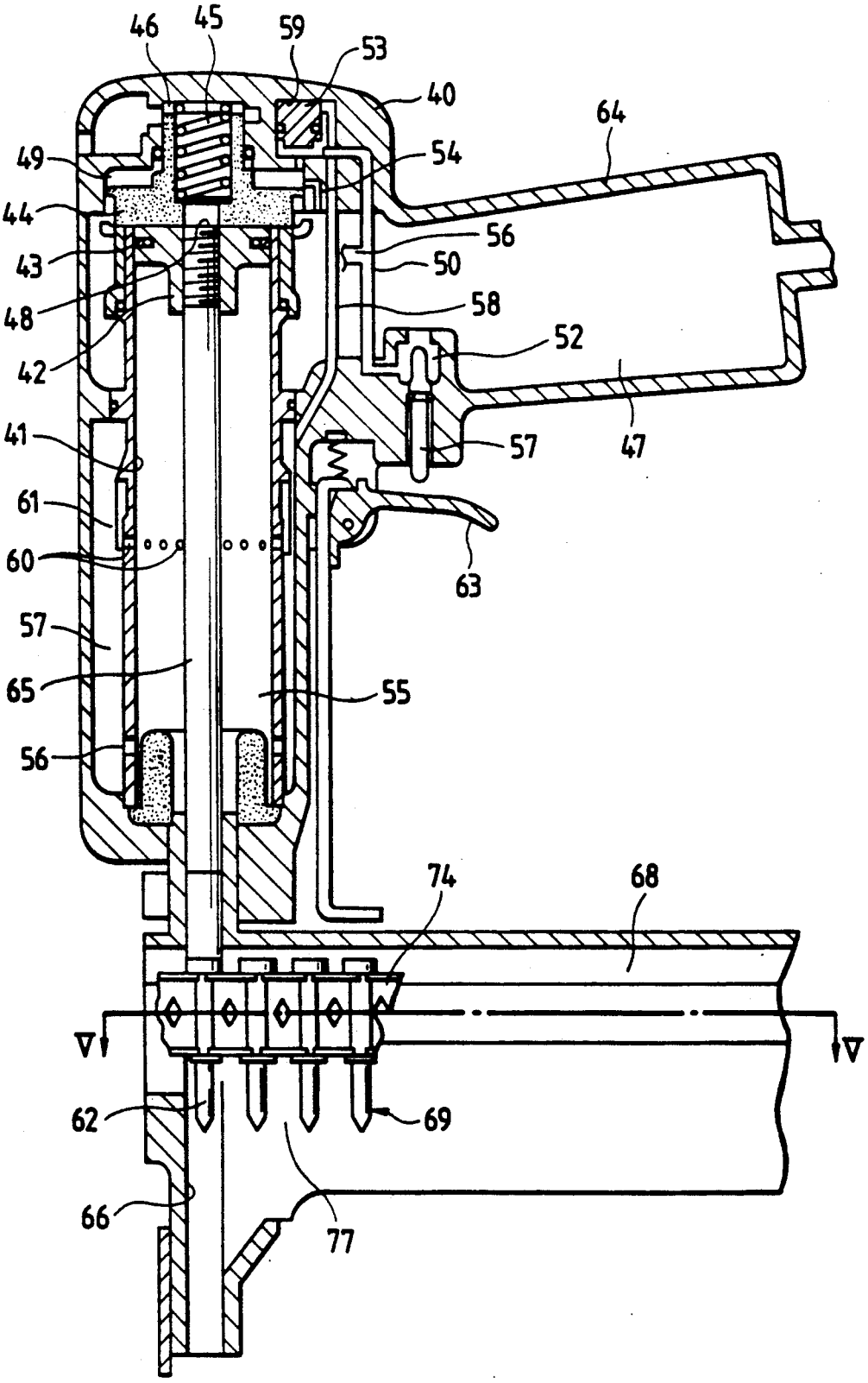
FIG. 2 is a longitudinal cross-sectional view of the fastener driving tool shown in FIG. 1.

The fastener driving tool includes, as shown in FIG. 2, a tool body 40 having a tubular cylinder 41 in which a piston 42 is slidably received. The piston 42 is sealed from the cylinder 41 by a piston ring 43 attached to the periphery of the piston 42. A main valve 44 is slidably mounted in the tool body 40 directly above an upper end (rear end) of the cylinder 41. The main valve 44 is urged by a spring 45 in a direction such as to close the upper end of the cylinder 41. The upper end of the cylinder 41 is opened when the main valve 44 moves upwardly. With this upward movement of the main valve 44, a discharge valve 46 is closed whereupon a striking air chamber or accumulator 47 which is connected with a compressed air supply such as a compressor (not shown) is brought into communication with an upper piston chamber 48 defined above the piston 42. Conversely, when the main valve 44 is lowered to close the upper end of the cylinder 41, the discharge valve 46 is opened so that the upper piston chamber 48 communicates with the outside air. A main valve chamber 49 holding therein the main valve 44 is communicated via a first passage 50 with a valve element or switch 51 of a control valve 52, with a repeat valve 53 disposed in the first passage 50 at a position between the switch 51 and the main valve chamber 49. The main valve chamber 49 communicates with the accumulator 47 through a second passage 54.

The cylinder 41 has a lower piston chamber 55 defined below the piston 42 and communicated via a compressed air supply passage 56 with an annular return air chamber 57 defined around a lower portion of the cylinder 41. The compressed air supply passage 56 is connected with the first passage 50. The return air chamber 57 is connected via a third passage 58 with a repeat valve chamber 59 in which the repeat valve 53 is disposed. The cylinder 41 further has a plurality of peripheral connecting passages 60. The connecting passages 60 interconnect the upper piston chamber 48 and the lower piston chamber 55 via a check valve 61 when the piston 42 moves past the connecting passages 60 during its downward stroke. The connecting passages 60 thus provided serve to prevent bouncing of the tool body 40 which would otherwise occur when a fastener 62 being driven to a work piece comes to a halt due to insufficient fastener driving energy. To this end, the cross-sectional area and position of the connecting passages 60 are determined such that the compressed air in the upper piston chamber 48 is introduced successively through the connecting passages 60, the return air chamber 57 and the supply passage 56 into the lower piston chamber 55 before the fastener 62 being driven comes to a halt. With the compressed air thus introduced, the pressure in the lower piston chamber 55 becomes substantially equal to or greater than the pressure in the upper piston chamber 48.

A trigger 63 is pivoted to a portion of the tool body 40 adjacent to the base of a handle 64. The trigger 63 is adapted to be actuated by the user's finger to activate the switch 51 of the control valve 52. Upon activation of the control valve 52, the main piston 42 and a driving rod 65 connected thereto are reciprocated several times for driving the fastener 62 through a cylindrical barrel 66 into the work piece.

Figure 9:
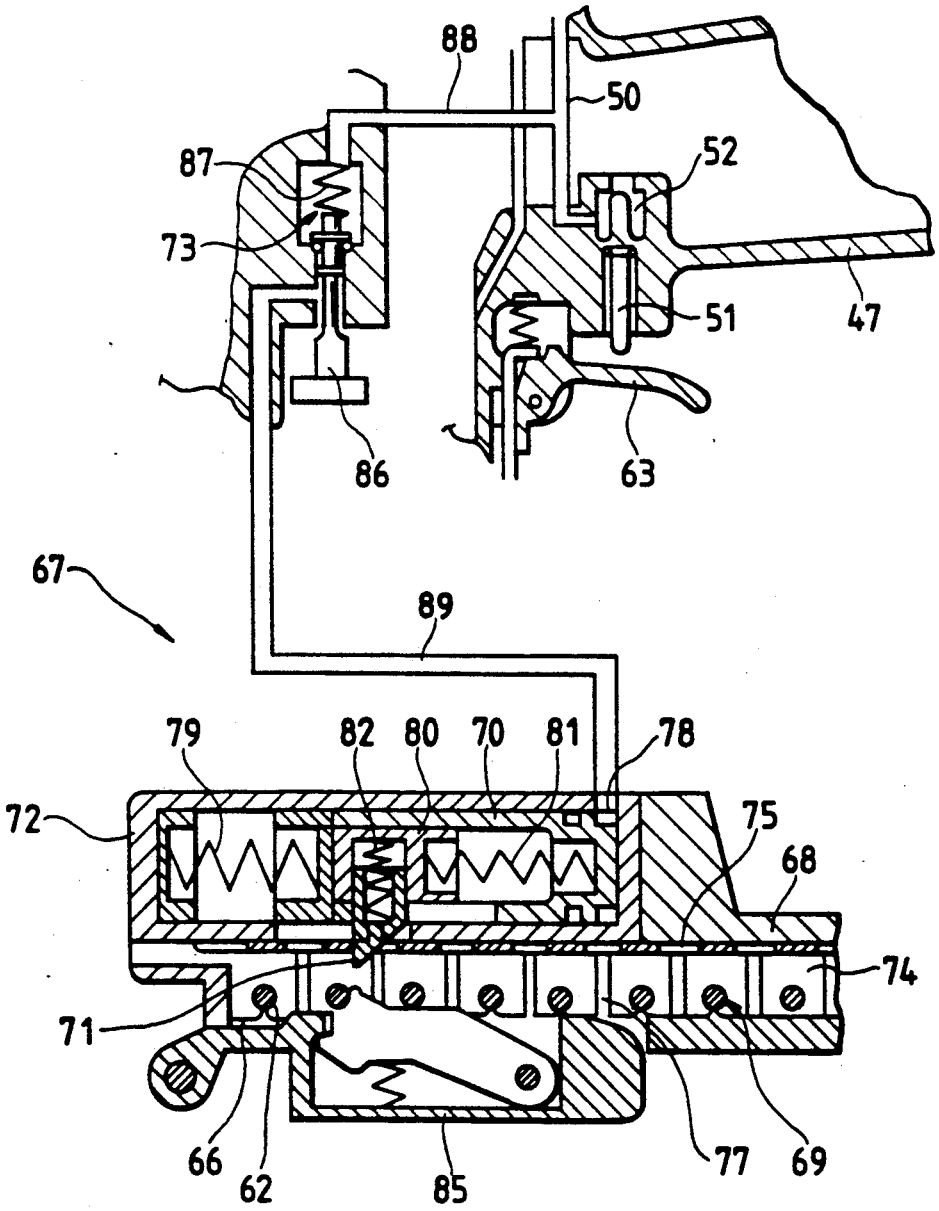
FIG. 9 is a diagrammatical cross-sectional view of the fastener supply unit shown with parts in the inoperative position.

The fastener driving tool further includes a fastener supply unit 67 (FIG. 9) for feeding the fasteners 62 one at a time to an inlet of the barrel 66. As shown in FIG. 9, the fastener supply unit 67 comprises an elongate magazine 68 integral with the barrel 66 and extending perpendicularly to the axis of the barrel 66 for receiving therein a continuous fastener strip 69, a feed piston 70 having a feed prong 71 and slidably received in a cylinder 72 disposed on one side of the magazine 68, and a feed valve 73 disposed adjacent to the trigger 63 for reciprocating the piston 70 and the feed prong 71 to feed the leading fastener 62 to the inlet of the barrel 66.

Figure 7:
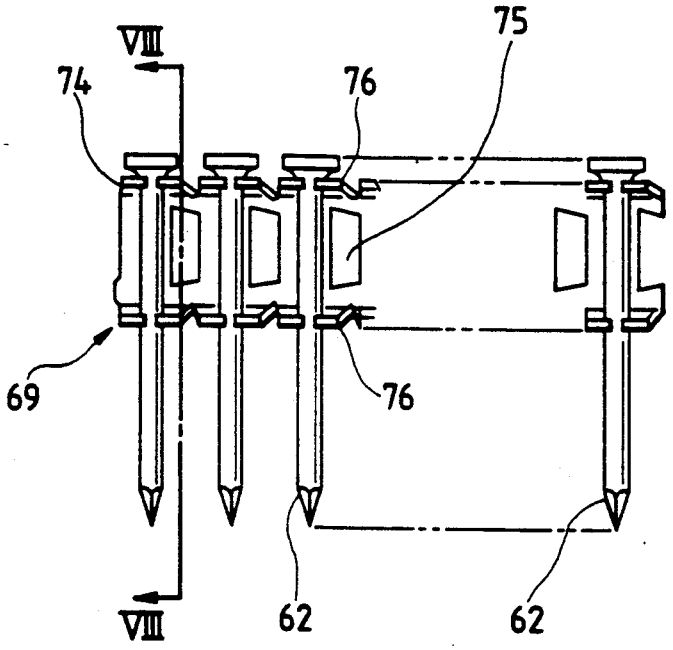
FIG. 7 is a fragmentary front elevational view of a fastener strip including a feed belt carrying thereon a succession of fasteners adapted to be driven by the fastener driving tool of the present invention.
Figure 8:
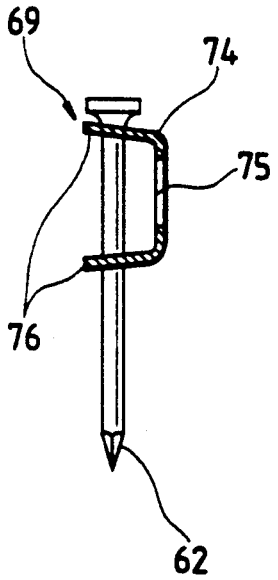
FIG. 8 is a cross-sectional view taken along line VIII—VIII of FIG. 7.

The fastener strip 69 comprises, as shown in FIGS. 7 and 8, a continuous feed belt 74 of a U-shaped cross-section and a number of fasteners 62 carried on the feed belt 74 at equal intervals. The feed belt 74 has a plurality of guide holes 75 longitudinally spaced at equal intervals, and a pair of rows of support lips 76 disposed on and along opposite longitudinal edges of the feed belt 74 and projecting laterally therefrom in a common direction. Each of the fasteners 62 is supported on one of confronting pairs of the support lips 76. The fastener strip 69 thus constructed is loaded in the magazine 68, with the fasteners 62 disposed parallel to the axis of the driving rod 66 as shown in FIG. 2. The magazine 68 has a longitudinal guide groove 77 extending perpendicularly across the inlet of the barrel 66 for the passage of the fastener strip 69.

Figure 5:
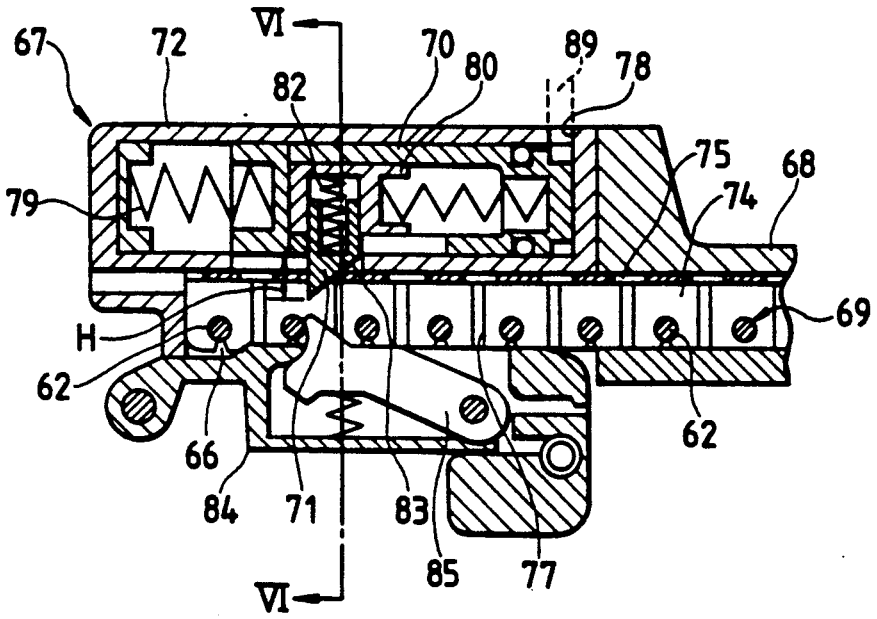
FIG. 5 is an enlarged cross-sectional view taken along line V—V of FIG. 2.
Figure 6:
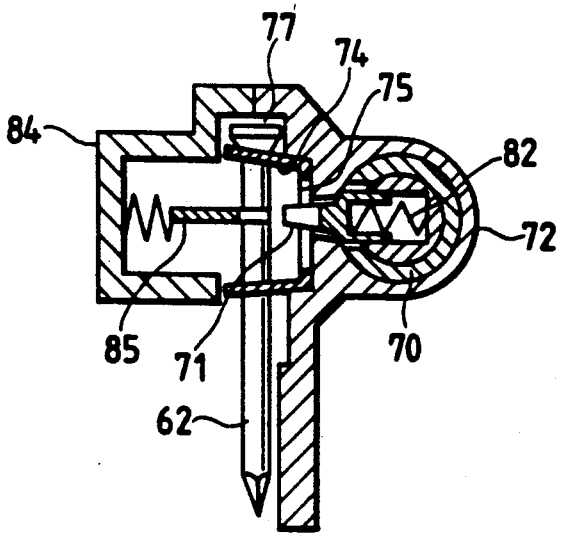
FIG. 6 is a cross-sectional view taken along line VI—VI of FIG. 5.

As shown in FIG. 5, the cylinder 72 has a compressed air inlet/outlet port 78 at an end remote from the barrel 66 for receiving therethrough the compressed air so as to displace the feed piston 70 toward the barrel 66. The piston 70 is normally urged by a first compression coil spring 79 in a direction away from the barrel 66. The feed piston 70 has a hollow cylindrical shape and slidably holds therein a slider 80. The slider 80 is normally urged by a second compression coil spring 81 in a direction toward the barrel 66. The second spring 81 has a greater spring force than the first spring 79 for a purpose described later. The feed prong 71 is slidably mounted on the slider 80 and urged by a third compression coil spring 82 to project into the guide groove 77 for locking engagement with the guide holes 75 in the feed belt 74. The front end of the feed prong 71 is beveled so as to provide an inclined rear surface 83 facing away from the barrel 66. With this inclined rear surface 83, the spring-loaded feed prong 71 possesses a ratchet-like function. In other words, the feed prong 71 is displaced away from the barrel 66 during the return stroke of the feed piston 70 in which instance due to frictional engagement between the inclined guide surface 83 and the edge of the guide hole 75 in the feed belt 74, the feed prong 71 is retracted away from the guide groove 77 against the force of the third spring 82. Then the feed prong 71 slides along the feed belt 74 without deforming the feed belt 74 and thereafter, at the end of the rearward stroke of the feed piston 70, the feed prong 71 projects into the next following guide hole 75 under the force of the third spring 82. Since the feed prong 71 is retractable, it may have a large height H which enables a reliable engagement with the feed belt 74 and a reliable feeding of the fastener strip 69 with respect to the barrel 66. Furthermore, the fastener strip 69 and more particularly the feed belt 74 of the fastener strip 69 can be fed neatly without damage or deformation and hence the guide groove 77 is free from jamming with a deformed feed belt 74. Another advantage resulting from the retractable feed prong 71 is that the loading of a fastener strip 69 can be achieved easily by merely pushing the fastener strip 96 into the guide groove 77 from the rear end of the magazine 68, without opening a hinged guide block 84 disposed on the opposite side of the cylinder 72. The hinged guide block 84 is provided with a spring-loaded locking pawl 85 lockingly engageable with a fastener 62 to lock the fastener strip 69 in position against rearward movement.

Figure 3:
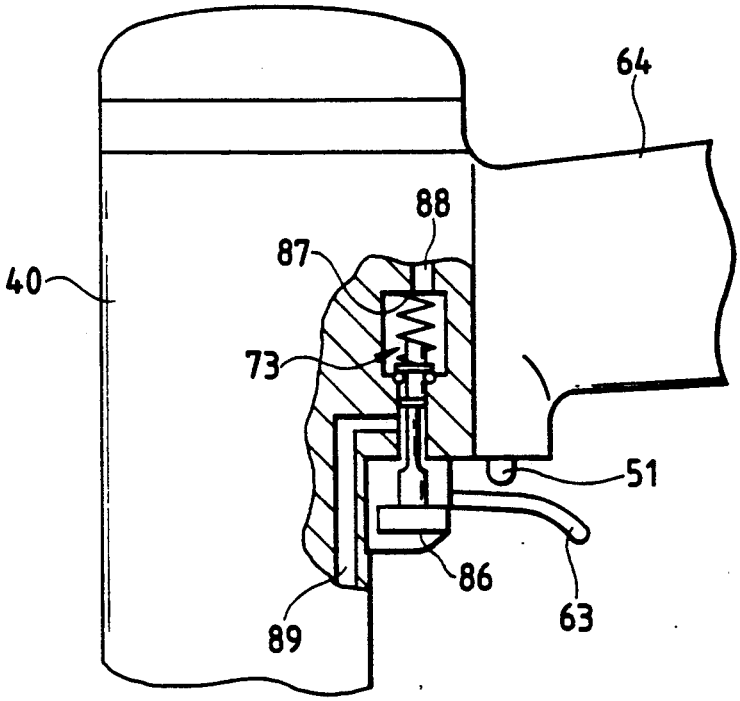
FIG. 3 is a fragmentary front elevational, partly cross-sectional view of a portion of the fastener driving tool, showing an actuator associated with a fastener supply
Figure 4:
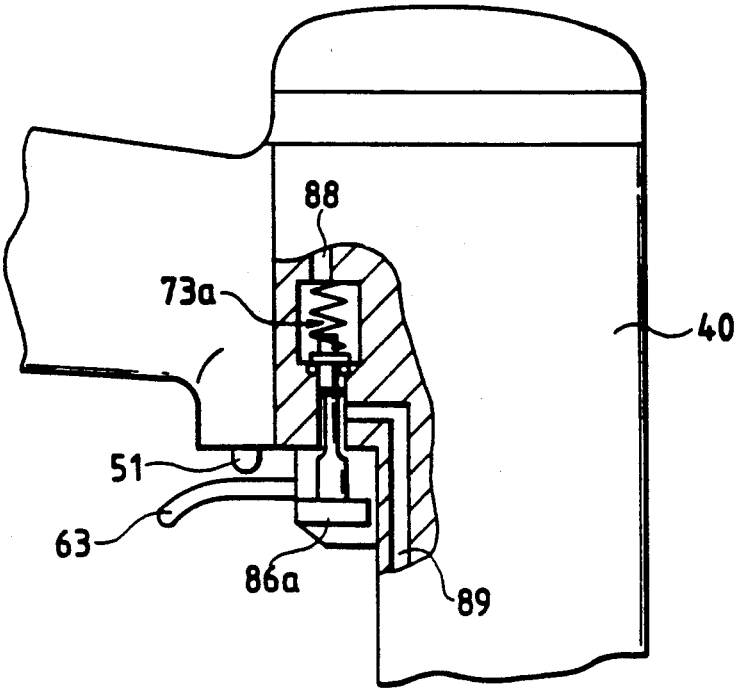
FIG. 4 is a rear view of FIG. 3.

As shown in FIG. 3, the feed valve 73 of the fastener supply unit is disposed in the tool body 40 adjacent to and diagonally above the trigger 63. The feed valve 73 includes a valve element or actuator 86 partly exposed to the left side of the tool body 40 and adapted to be operated by the user's finger to open the feed valve 73. The actuator 86 is urged by a return spring 87 in a direction to close the feed valve 73. The feed valve 73 is connected at its one end with a compressed air supply passage 88 extending from the first passage 50 (FIG. 9) and, at the other end, with another compressed air supply passage 89 leading to the inlet/outlet port 78 (FIG. 9) of the cylinder 72. These supply passages 88, 89 communicate with each other when the feed valve 73 is opened by pushing the actuator 86. In this instance, the supply passage 89 is also communicated with the accumulator 47 via the control valve 50 so long as the switch 51 is not activated by the trigger 63. As shown in FIG. 4, a similar feed valve **73*a* having an actuator 86*a* is disposed on the right side of the tool body 40 in symmetric relation to the feed valve 73 with respect to a central plane of the handle 64. Likewise the left side feed valve 73 (FIG. 3), the right side feed valve 73*a* is connected at opposite ends to the supply passages 88, 89. As an alternative, the left and right actuators 86, 86*a* may be linked together to operate a single feed valve 73 or 73*a***.

The actuators 86, **86*a* are disposed adjacent to the trigger 63 and are manually operable by a finger of a hand which is used for gripping the handle 64. Thus, only one hand is occupied in manipulating the fastener driving tool and. Accordingly, the fastener driving tool is particularly useful when applied to a horizontal or an overhead fastener driving operation where the user must hold a work piece with one hand. Furthermore, the actuators 86, 86*a* are disposed on opposite sides of the tool body 40** and hence the fastener driving tool can be operated neatly by both right-handed users and left-handed users.

The pneumatic fastener driving tool of the foregoing construction operates as follows. For purposes of illustration, the operation begins with parts in the condition shown in FIGS. 2 and 9 in which the leading fastener 62 is loaded in the inlet of the barrel 66 and the piston 42 is disposed in its uppermost position and hence the driving rod 65 is separated upwardly away from the leading fastener 62.

Figure 10:
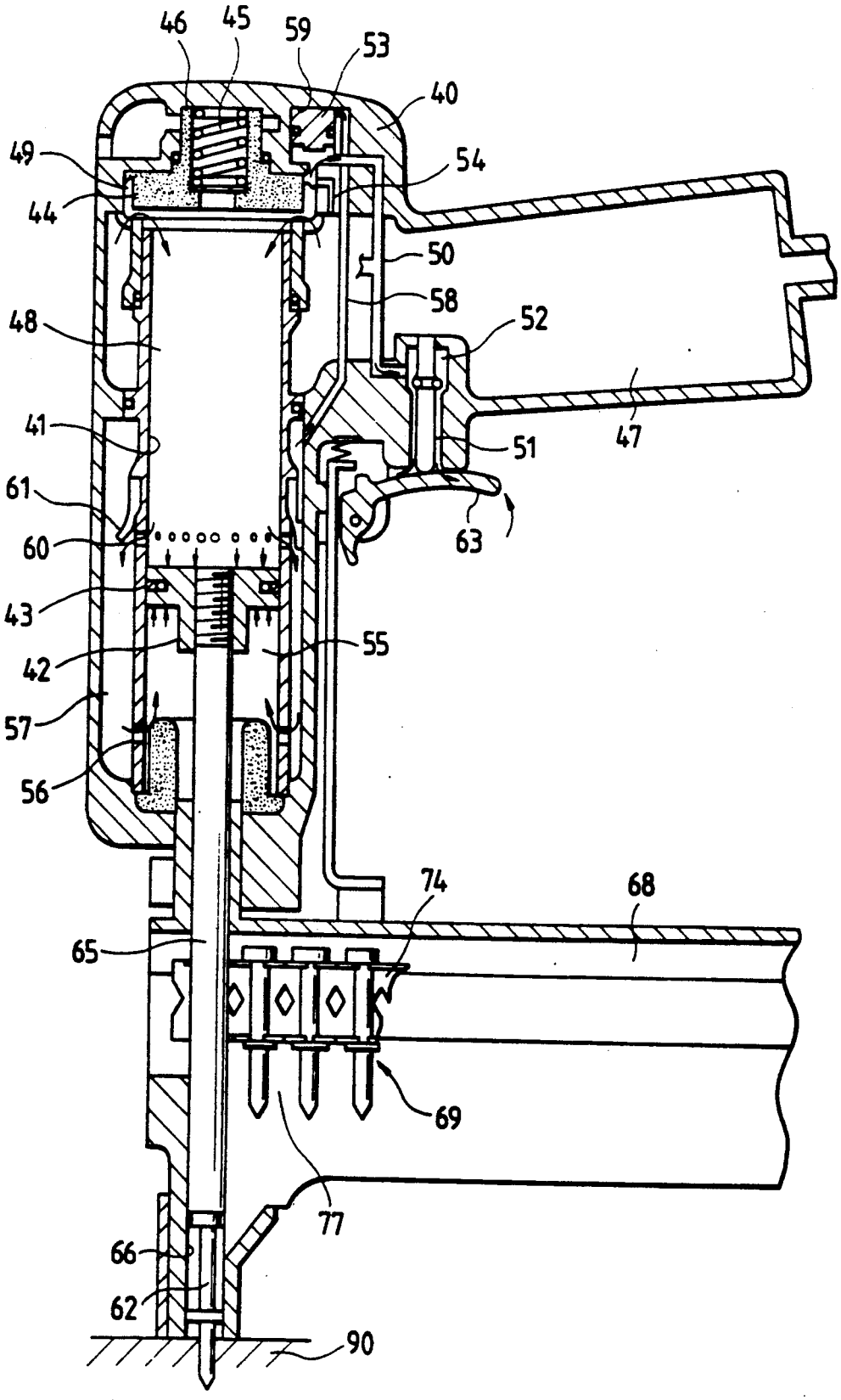
FIG. 10 is a view similar to FIG. 2, but showing the fastener driving tool as it is triggered.

When the trigger is pulled by the user's finger as shown in FIG. 10, the switch 51 is activated to thereby open the control valve 52. Thus, the compressed air in the main valve chamber 49 is discharged through the first passage 50 and through the control valve 52 to the outside of the tool body 40 so that the main valve 44 is lifted against the force of the return spring 45. With this upward movement of the main valve 44, the discharge valve 46 is closed and the upper end of the cylinder 41 is opened whereupon the upper piston chamber 48 communicates with the accumulator 33. Thus, the compressed air stored in the accumulator 47 flows into the upper piston chamber 48 and acts on the piston 42 to drive the leading fastener 62 into a work piece 90 by means of the driving rod 65. In this instance, a pneumatic energy of the compressed air is transmitted as kinetic energy to the piston 42. During downward stroke of the piston 42, the piston 42 moves past the connecting passages 60 whereupon the compressed air in the upper piston chamber 48 flows successively through the connecting passages 60, the return air chamber 57 and the supply passage 56 into the lower piston chamber 55 to thereby increases the pressure in the lower piston chamber 55.

Figure 11:
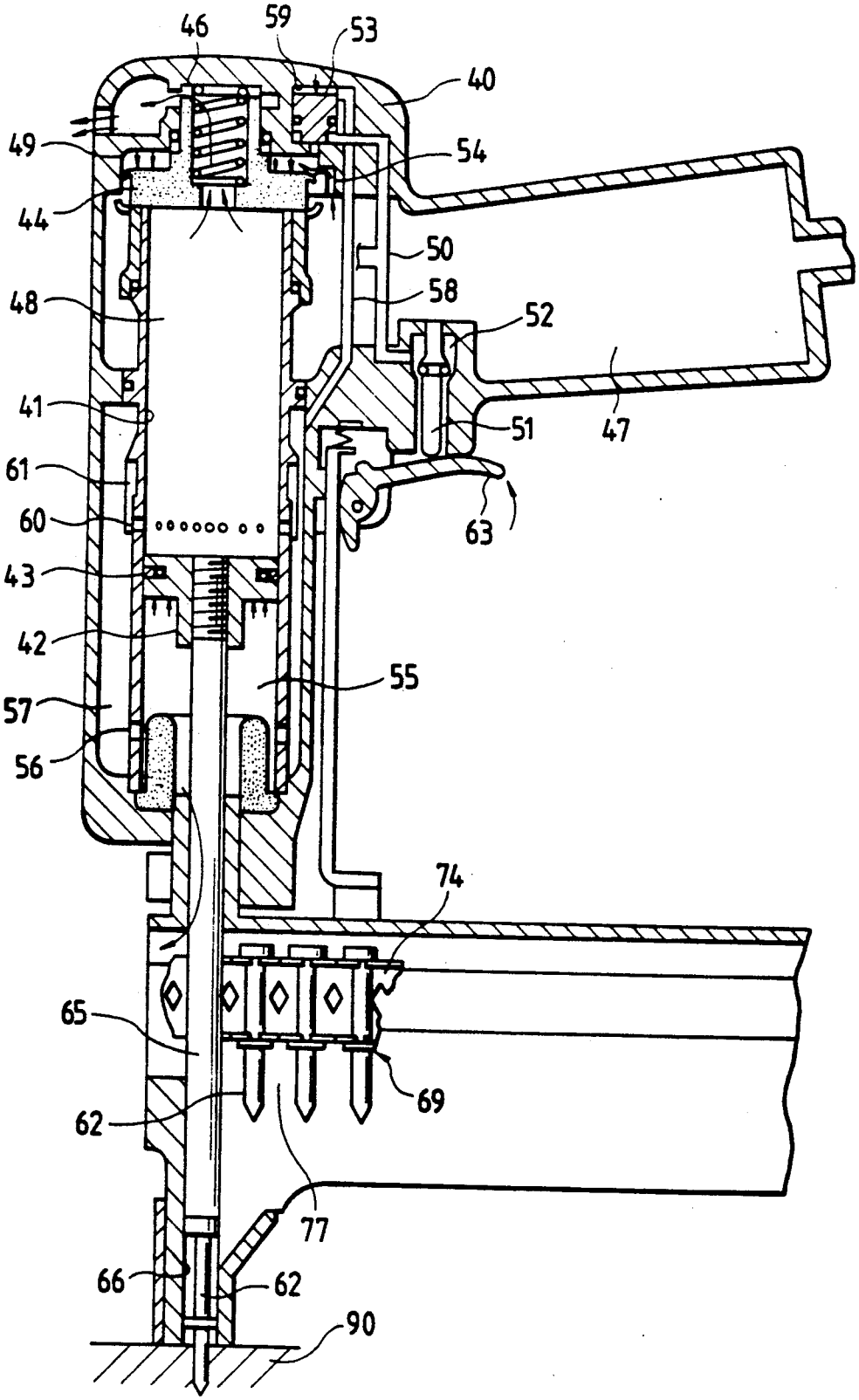
FIG. 11 is a view similar to FIG. 10, but showing a rearward or return stroke of a fastener driving piston.

On the other hand, the repeat valve chamber 59 communicates through the third passage 58 with the lower piston chamber 55. Consequently, a pressure rise in the lower piston chamber 55 causes the repeat valve 53 to move downward to thereby close the first passage 50. Thus, the compressed air from the accumulator 47 flows through the second passage 54 into the main valve chamber 49 to increase the pressure in the main valve chamber 49 so that the main valve 44 is lowered to close the upper end of the cylinder 41 and at the same time open the discharge valve 46 to thereby discharge the compressed air in the upper piston chamber 48 to the outside air, as shown in FIG. 11. Consequently, the piston 42 is returned to its uppermost position by the pressure in the lower piston chamber 55. As the piston 42 moves upward, the volume in the lower piston chamber 55 gradually increases and conversely the pressure in the lower piston chamber 55 decreases. The pressure drop in the lower piston chamber 55 is enhanced because a part of the compressed air is discharged from the lower piston chamber 55 through a clearance between the barrel 66 and the driving rod 65. With this pressure drop in the lower piston chamber 55, the pressure in the repeat valve chamber 59 is lowered and hence the repeat valve 53 is lifted by the pressure in the main valve chamber 49. Thus, the first passage 50 is opened whereupon the compressed air in the main valve chamber 49 is discharged from the control valve 52 and the main valve 44 is lifted again to open the upper end of the cylinder 41, as shown in FIG. 10. Consequently, the aforesaid fastener driving operation is started again. With the repeat valve 53 thus provided, the foregoing cycle of operation is automatically repeated until the leading fastener is fully driven into the work piece 90.

Then the trigger 63 is released to deactivate the switch 51 whereupon the compressed air in the accumulator 47 flows through the first passage 50 into the main valve 49, thereby lowering the main valve 44 to close the upper end of the cylinder 41, as shown in FIG. 2. Thus the repeated fastener driving operation is terminated.

Figure 12:
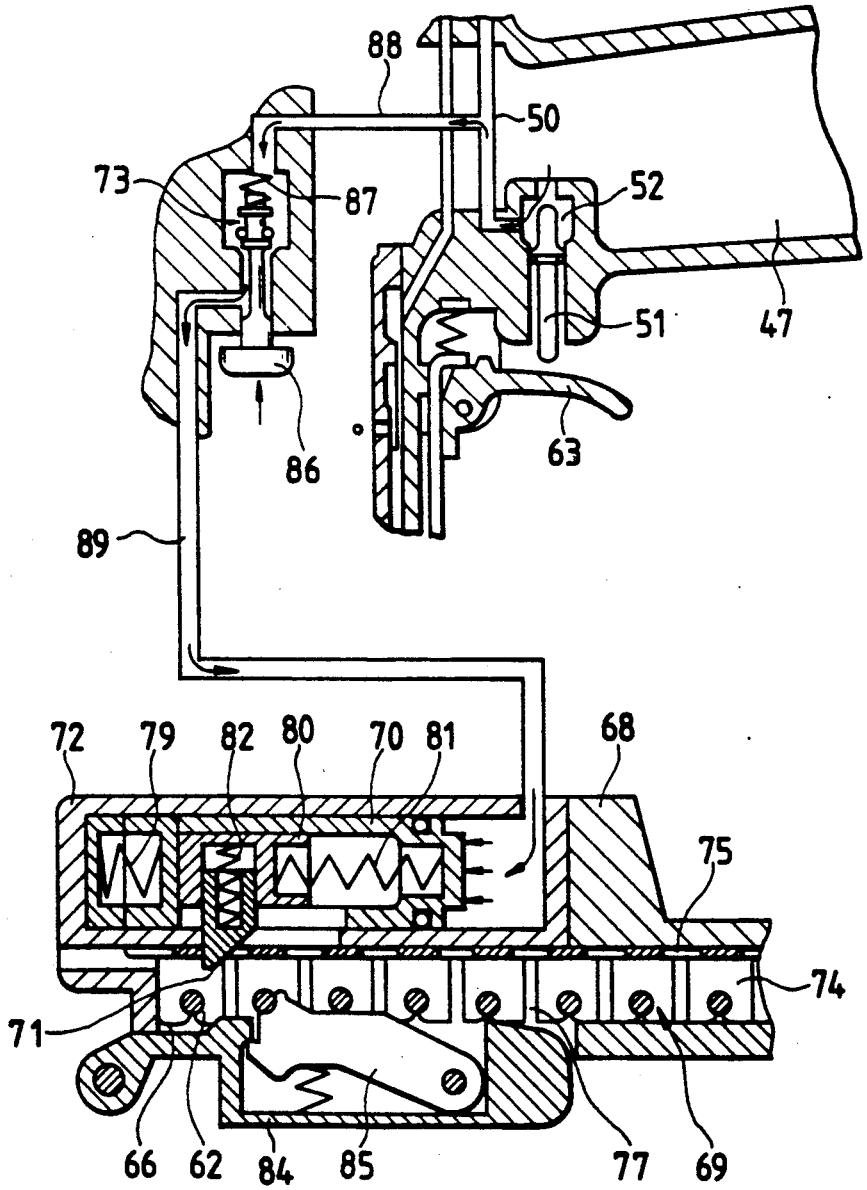
FIG. 12 is a view similar to FIG. 9, but showing the fastener supply unit as it is driven for supplying the leading fastener to a barrel of the fastener driving tool.

Thereafter, the next following fastener 62 is fed into the inlet of the barrel 66 by the fastener supply unit 67. In this instance, one of the actuators 88, 86*a*, for example, the left side actuator 86 as illustrated in FIG. 12, is pushed by the user's finger to open the feed valve 73 against the force of the spring 87. Then, the compressed air in the accumulator 47 flows successively through the control valve 52, the supply passage 88, the feed valve 73 and the supply passage 89, then further flows into the cylinder 72 through the inlet/outlet port 78, thereby advancing the feed piston 70 toward the barrel 66. With this advancing movement of the feed piston 70, the feed prong 71 while being held in locking engagement with the guide hole 75 in the feed belt 74 is displaced in the same direction to thereby advance the fastener strip 69 until the next fastener 62 is loaded in the inlet of the barrel 66.

Thereafter, the actuator 86 is released whereupon the compressed air supplied from the accumulator 47 to the cylinder 72 is blocked by the feed valve 73 and the compressed air in the cylinder 72 is discharged from the feed valve 73. As a result, the feed piston 70 and the feed prong 71 connected thereto are displaced rearwardly by the force of the first spring 79. During that time, the feed prong 71 is first retracted from the guide groove 77 against the force of the third spring 82, then slides along the feed belt 7 until its arrival at the next following guide hole 75 whereupon the feed prong 71 is urged into locking engagement with this guide hole 75 by means of the third spring 82, as shown in FIG. 9.

Figure 29:
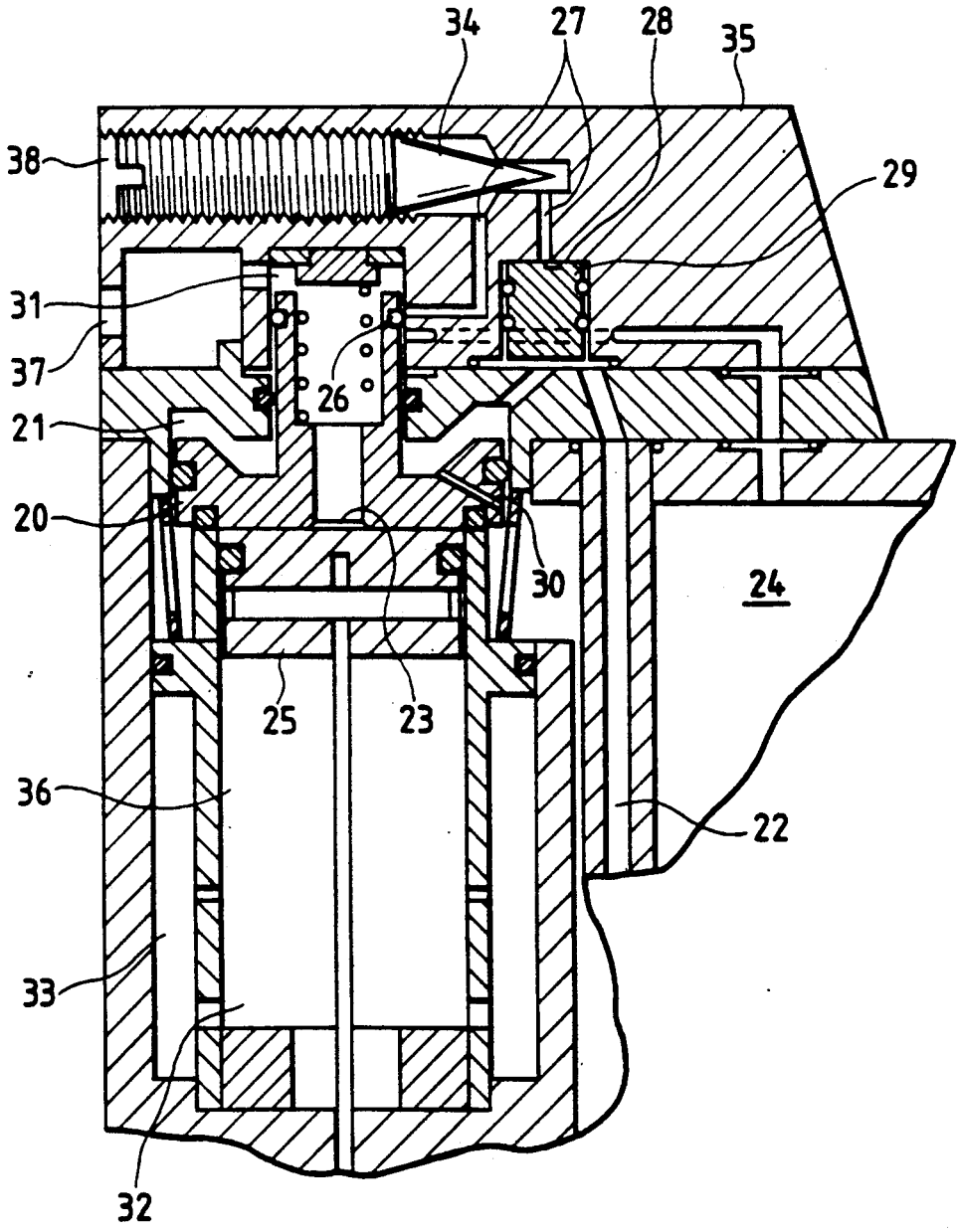
FIG. 29 PRIOR ART
FIG. 29 is a fragmentary cross-sectional view of a fastener driving tool having an automatic repeated striking mechanism according to the prior art.

According to the embodiment described above, the repeat valve 53 is disposed in the first passage 50 for opening and closing the same, and the lower piston chamber 55 and the repeat valve chamber 59 are connected via the third passage 58. With this construction, the repeat valve 53 is operative, in response to a change of pressure in the lower piston chamber 55, to reciprocate the main valve 44, thereby enabling a repeated fastener striking operation by the piston 42. Since the movement of the repeat valve 53 is directly related to the movement of the piston 42, the fastener driving operation can be performed reliably even when the fastener driving tool is powered with a relatively low pneumatic pressure or it is operating at a relatively short repetition cycle time. Furthermore, the present fastener driving tool, as against the conventional fastener driving tool shown in FIG. 29, is not provided with a changeover valve and hence is simple in construction and easy to maintain and can be manufactured at a low cost.

Figure 13:
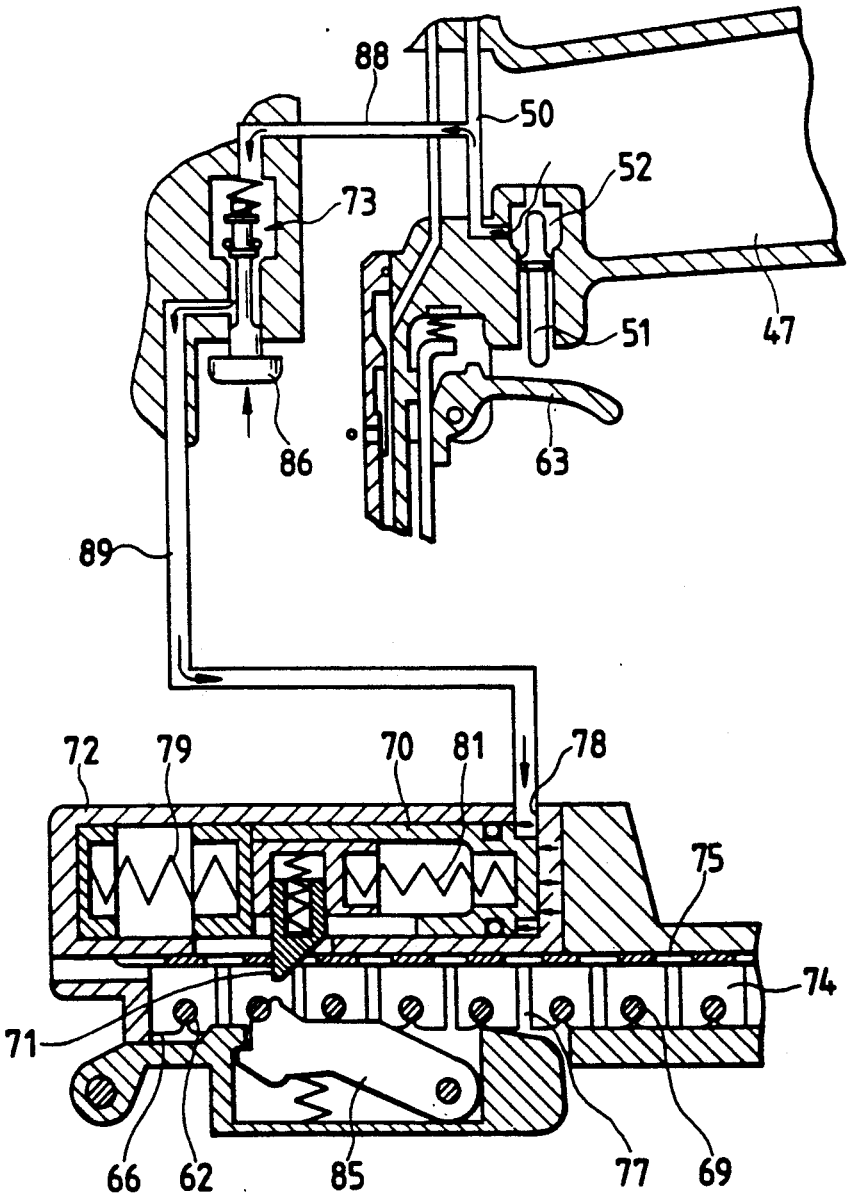
FIGS. 13 and 14 are views similar to FIG. 9, but illustrating a sequence of operation of the fastener supply unit which takes place when the actuator is inadvertently operated without regard of the presence of a fastener in the barrel of the fastener driving tool.
Figure 14:
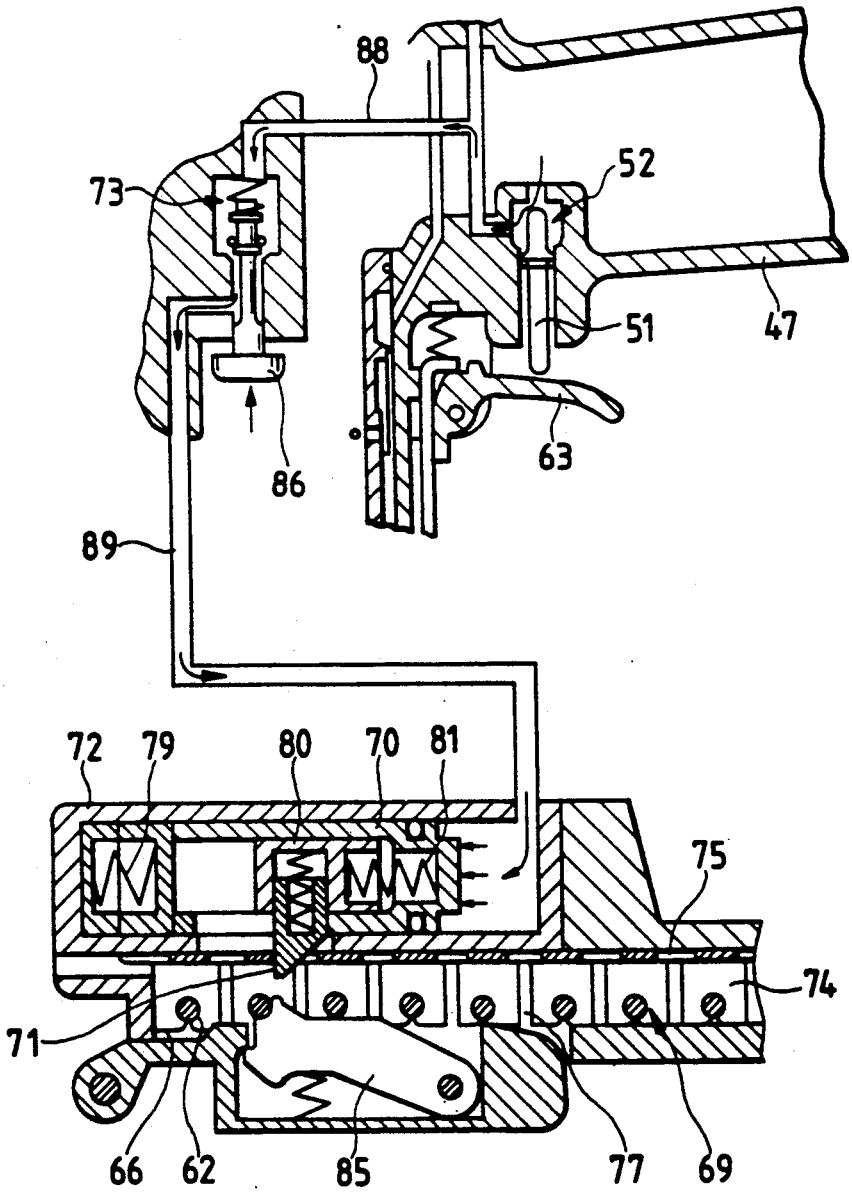

When the actuator 86 is operated inadvertently without regard for the presence of the leading fastener 62 at the inlet of the barrel 66, as shown in FIG. 13, the compressed air is supplied from the inlet/outlet port 78 into the cylinder 72 and acts on the feed cylinder 70, tending to move the feed prong 71 forwardly to feed the second leading fastener 62 to the inlet of the barrel 66. However, due to the presence of the leading fastener 62 at the barrel inlet, the forward movement of the fastener strip 69 is not possible. When the pressure acting on the feed piston 70 exceeds the force of the second spring 81, the second spring 81 is compressed whereupon the feed piston 70 is displaced forwardly against the force of the first spring 79, as shown in FIG. 14. In this instance, however, the feed prong 71 stays in its original position because the feed prong 71 is mounted on the slider 80 which is slidably received in the feed piston 70. This condition is maintained even when the actuator 86 is released. During that time, the compressed air is discharged from the cylinder 72 through the supply passage 89 and the feed valve 73, then the feed piston 70 is returned to its original position under the force of the second spring 81. With this rearward movement of the feed piston 70, the first spring 79 restore its initial posture shown in FIG. 9. Since the feed piston 70 is normally urged in a direction away from the barrel 66, a dangerous double loading of the fasteners 62 can be avoided and hence the fastener driving operation is achieved safely.

Figure 15:
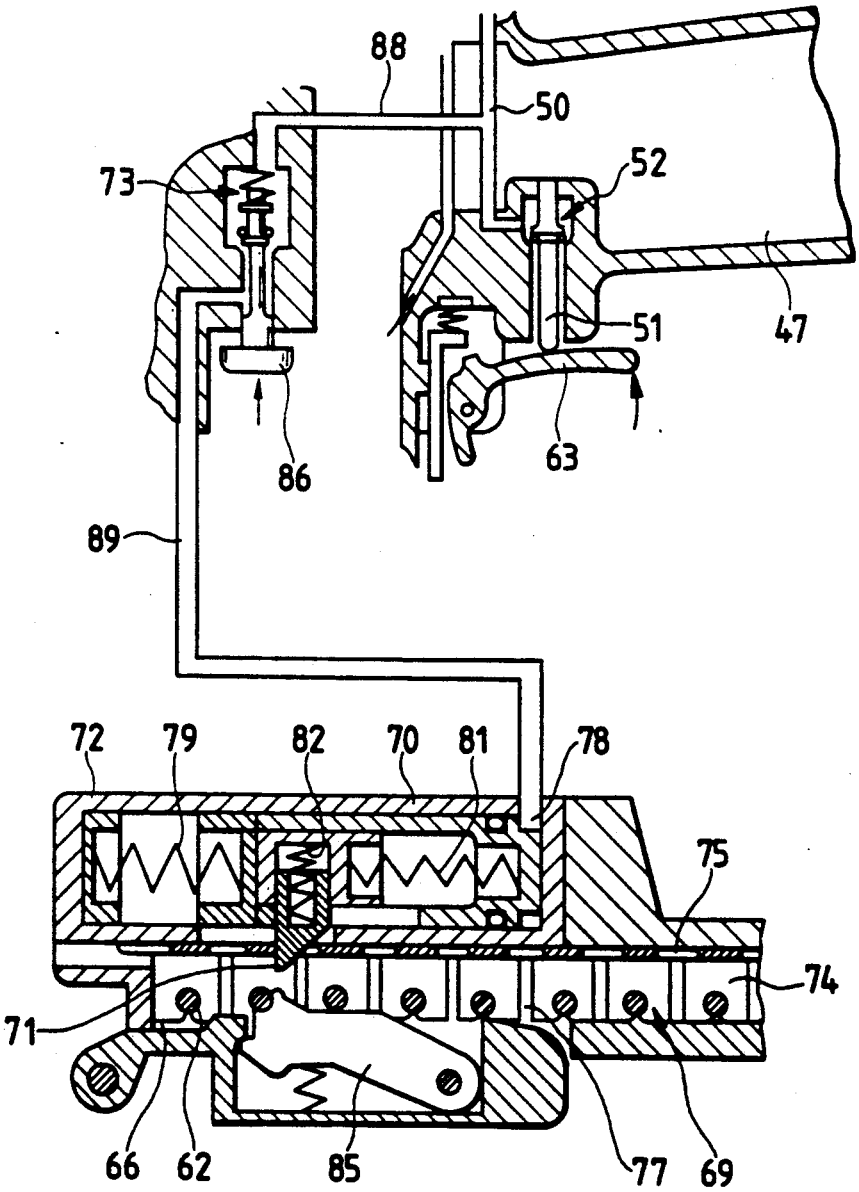
FIG. 15 is a view similar to FIG. 13, but showing the manner in which the fastener supply unit operates when the actuator and a trigger are operated simultaneously.

In the case where the user pushes the actuator 86 of the feed valve 73 while actuating the trigger 63 to activate the switch 51 as shown in FIG. 15, the compressed air in the accumulator 47 is not supplied to the cylinder 72 because the compressed air in the first passage 50 is discharged through the switch 51 of the control valve 52. Thus, the feed piston 70 and the feed prong 71 are held immovable and hence the loading of the next fastener 62 to the barrel 66 is perfectly prohibited.

Figure 16:
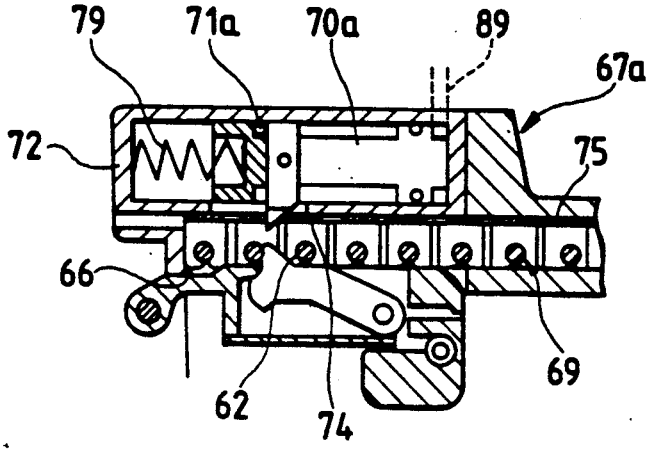
FIG. 16 is a view similar to FIG. 5, but showing a fastener supply unit according to another embodiment.

FIG. 16 shows a fastener supply unit 67*a* according to another embodiment of the present invention. The fastener supply unit 67*a* is similar to the fastener supply unit 67 shown in FIG. 5 but differs therefrom in that a feed prong 71*a* is not retractable and is directly connected to a solid feed piston 70*a*. Since the feed prong 71*a* is not retractable, the feed belt 75 is bent by the feed prong 71 as the latter moves away from the barrel 66. Accordingly, the fastener supply unit 67*a* of this embodiment is preferably used in combination with such a fastener strip 69 having a highly flexible feed belt 74.

Figure 17:
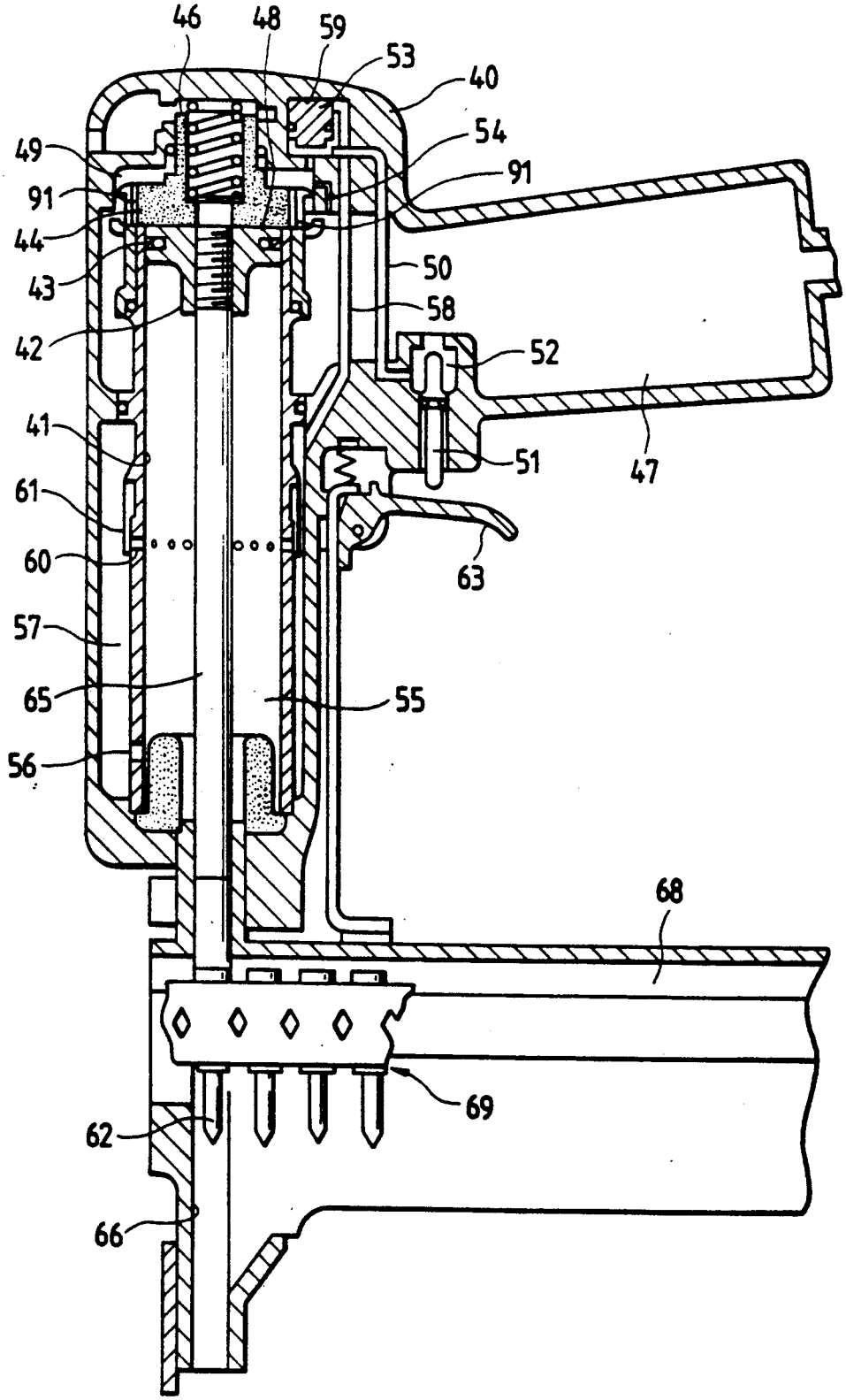
FIG. 17 is a longitudinal cross-sectional view of a modified fastener driving tool according to the present invention.

A modified fastener driving tool shown in FIG. 17 is substantially the same as the fastener driving tool shown in FIG. 2 with the exception that a main valve 44 has a plurality (two being shown) of circumferentially spaced axial connecting passages 91. The connecting passages 91 are positioned such that an accumulator 47 and a main valve chamber 49 communicate with each other via the connecting passages 91 during the upward stroke of a main valve 44, and the connecting passages 91 are closed by the upper end face of a cylinder 41 or the upper end face of a piston 42 when the main valve 44 is disposed in its bottom dead center. In other words, the connecting passages 91 are open during the reciprocating movement of the main valve 44 and closed upon arrival of the main valve 44 at its lowermost position or bottom dead center.

Figure 19:
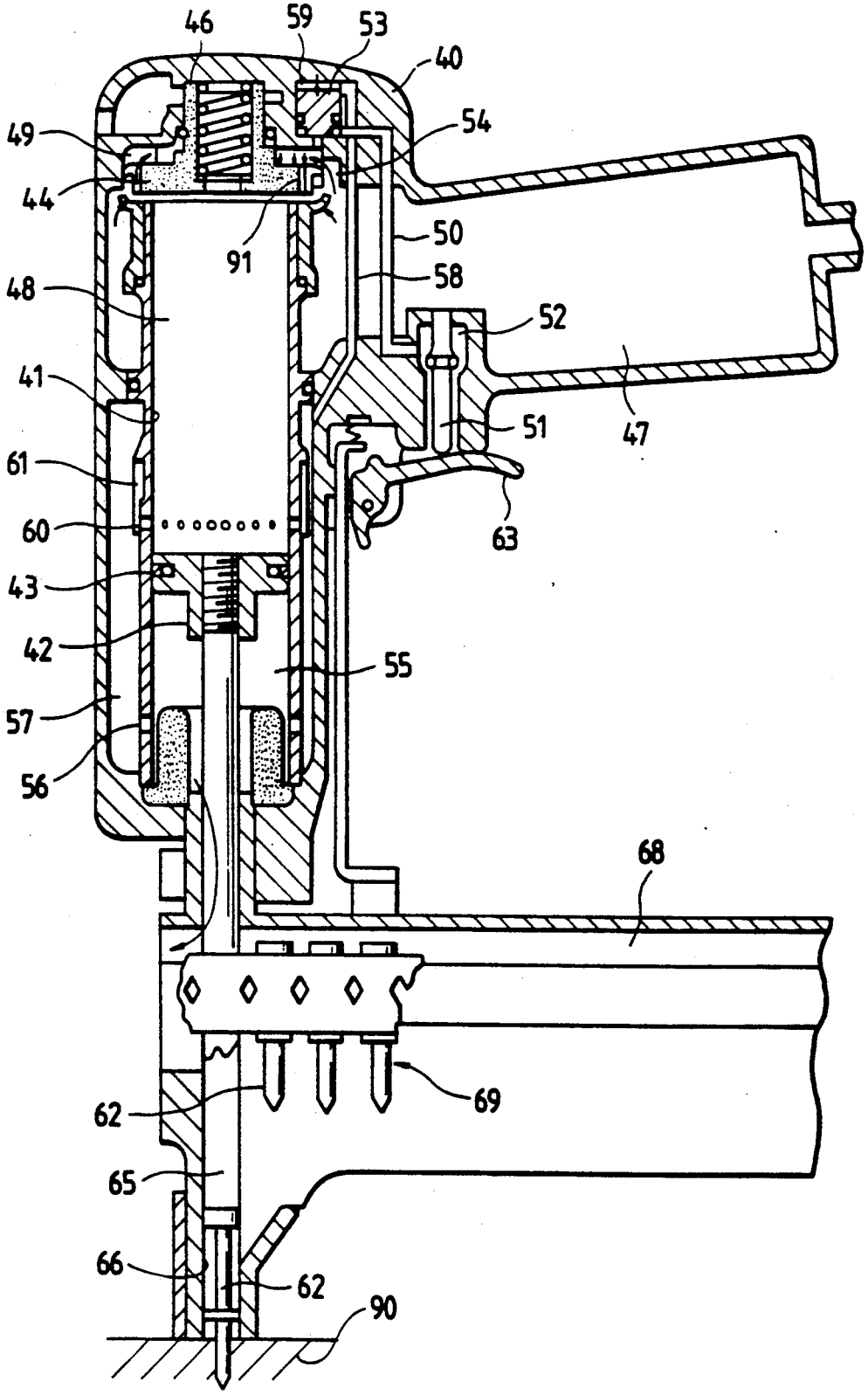
Figure 20:
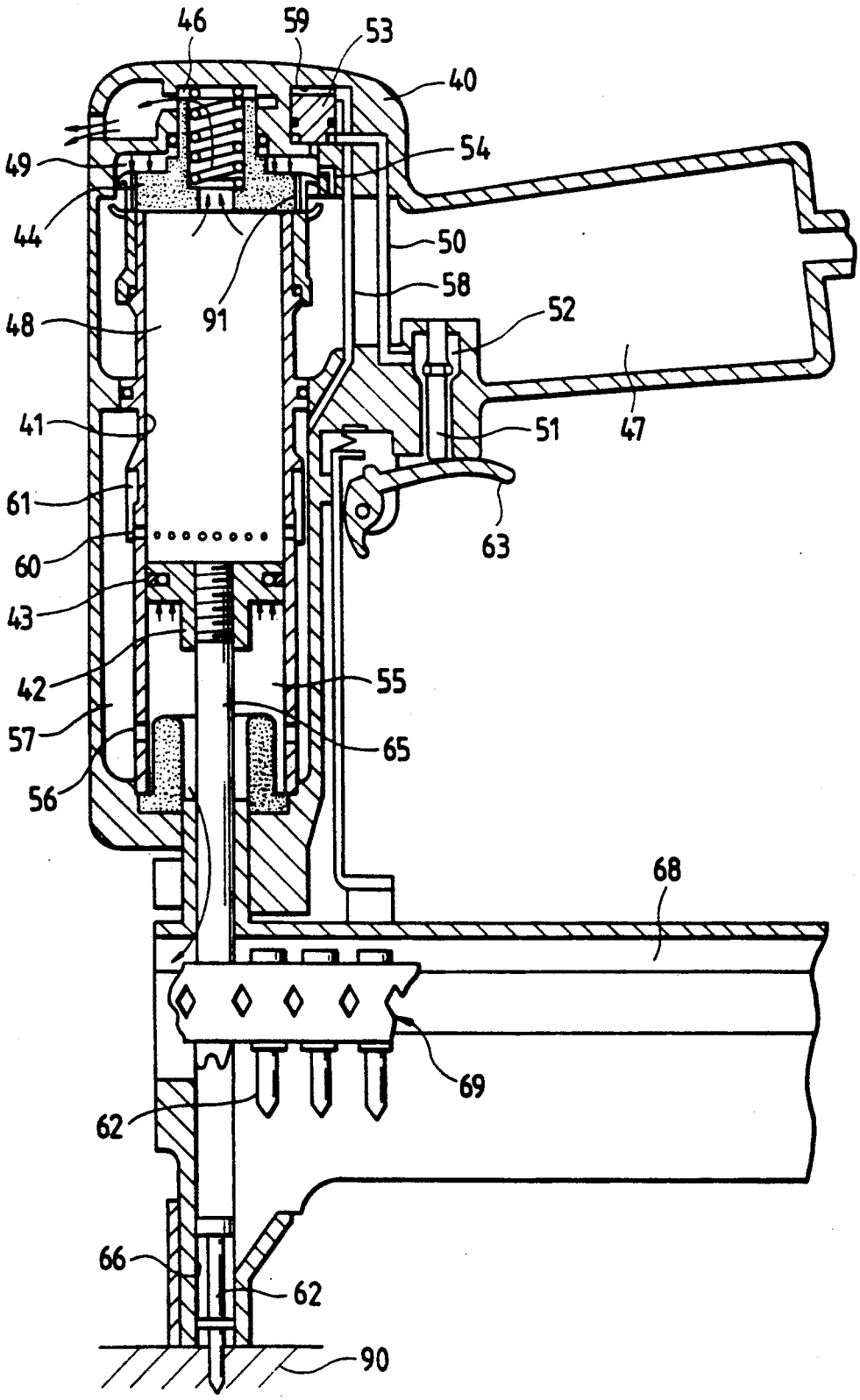

The operation of the modified fastener driving too will be described below with reference to FIGS. 18 through 20.

Figure 18:
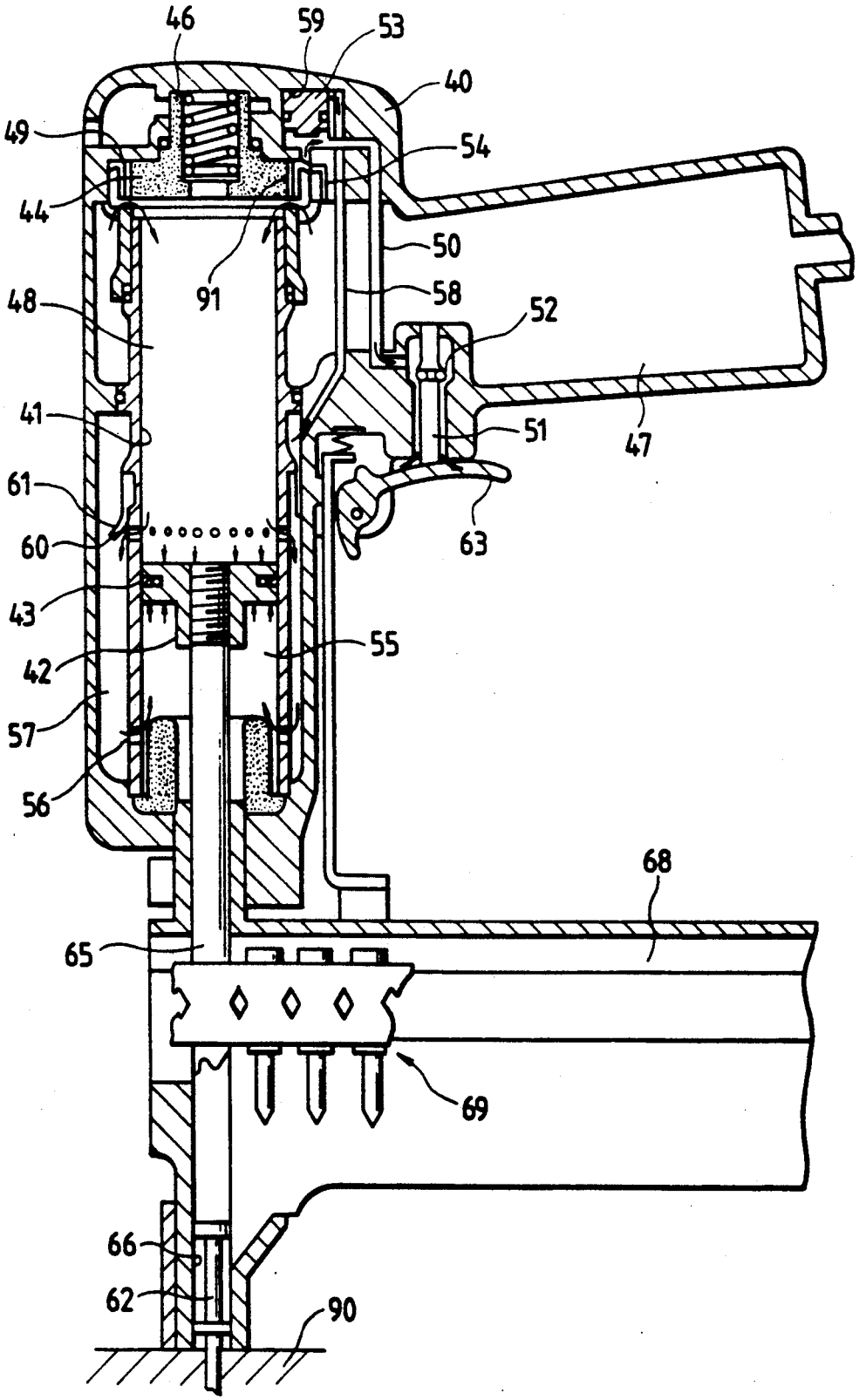
FIGS. 18 through 20 are longitudinal cross-sectional views illustrative of the operation of the modified fastener driving tool.

When the trigger 63 is pulled by the user's finger as shown in FIG. 18, the switch 51 is activated to open the control valve 52. Thus, the compressed air in the main valve chamber 49 is discharged through the first passage 50 and through the control valve 52 to the outside of the tool body 40 so that the main valve 44 is lifted against the force of the return spring 45. With this upward movement of the main valve 44, the discharge valve 46 is closed and the upper end of the cylinder 41 is opened whereupon the upper piston chamber 48 communicates with the accumulator 47. Thus, the compressed air stored in the accumulator 47 flows into the upper piston chamber 48 and acts on the piston 42 to drive the leading fastener 62 into a work piece 90 by means of the driving rod 65. In this instance, a pneumatic energy of the compressed air is transmitted as a kinetic energy to the piston 42.

During downward stroke of the piston 42, the piston 42 moves past the connecting passages 60 whereupon the compressed air in the upper piston chamber 48 flows successively through the connecting passages 60, the return air chamber 57 and the supply passage 56 into the lower piston chamber 55 to thereby increases the pressure in the lower piston chamber 55.

On the other hand, the repeat valve chamber 59 communicates with the lower piston chamber 55 via the third passage 58. Consequently, a pressure rise is created in the lower piston chamber 55 which will cause the repeat valve 53 to move downward for closing the first passage 50. Thus, the compressed air from the accumulator 47 flows into the main valve chamber 49 via the second passage 54 and the connecting passages 91, thereby increasing the pressure in the main valve chamber 49. With this pressure rise in the main valve chamber 49, the main valve 44 is lowered toward the upper end of the cylinder 41, as shown in FIG. 19. Thereafter, the thus lowered main valve 44 arrives at its bottom dead center. In this instance, the upper end of the cylinder 41 is closed by the main valve 44 and the discharge valve 46 is opened, as shown in FIG. 20. Consequently, the compressed air in the upper piston chamber 48 is discharged to the outside air, and the piston 42 is returned to its uppermost position by the pressure in the lower piston chamber 55. As the piston 42 moves upward, the volume in the lower piston chamber 55 gradually increases and conversely the pressure in the lower piston chamber 55 decreases. The pressure drop in the lower piston chamber 55 is enhanced because a part of the compressed air is discharged from the lower piston chamber 55 through a clearance between the barrel 66 and the driving rod 65. With the pressure drop created in the lower piston chamber 55, the pressure in the repeat valve chamber 59 is lowered and hence the repeat valve 53 is lifted by the pressure in the main valve chamber 47. Thus, the first passage 50 is opened whereupon the compressed air in the main valve chamber 49 is discharged from the control valve 52.

In this instance, since the main valve 44 is disposed in its lowermost position or bottom dead center, the connecting passages 91 are closed by the upper end of the cylinder 41. Partly because the compressed air is prevented from flowing into the main valve chamber 49 through the connection passages 91, and partly because the cross-sectional area of the third passage 56 is considerably smaller than the cross-sectional area of the first passage 50, the pressure in the main valve chamber 49 drops rapidly. With this sudden pressure drop in the main valve chamber 49, the main valve 44 is lifted again and opens the upper end of the cylinder 41, as shown in FIG. 18. Consequently, the aforesaid fastener driving operation is started again. With the repeat valve 53 thus provided, the foregoing cycle of operation is automatically repeated until the leading fastener is fully driven to the work piece 90.

Then the trigger 63 is released to deactivate the switch 51 whereupon the compressed air in the accumulator 47 flows through the first passage 50 into the main valve chamber 49 to lower the main valve 44, thereby closing the upper end of the cylinder 41, as shown in FIG. 17. Thus the repeated fastener driving operation is terminated.

According to the foregoing embodiment shown in FIGS. 17 through 20, the repeat valve 53 interlocked with the main valve 44 is disposed in the first passage 50 extending between the accumulator 47 and the main valve chamber 49 in which the main valve 44 is received, and the connecting passages 91 are provided between the main valve chamber 49 and the accumulator 47 for connecting them, the connecting passages 91 being closed when the main valve 44 arrives at its bottom dead center. With this construction, when the main valve 44 moves to its top dead center, the repeat valve 53 operates and a discharge of the compressed air from the main valve chamber 49 is terminated. Then the compressed air flowing through the connecting passages 91 into the main valve chamber 49 lowers the main valve 44 until the main valve 44 reaches its bottom dead center whereupon the connecting passages 91 are closed. In this instance, the compressed air is discharged from the main valve chamber 49 through the first passage 50 but the compressed air is prevented from flowing into the main valve chamber 49 through the connecting passages 91. Accordingly, the connecting passages 91 may have a large cross-sectional area. Then, pressure in the main valve chamber 49 drops suddenly with the result that the main valve 44 is lifted at a high speed. With this rapid upward movement of the main valve 44, only a small amount of discharge of the compressed air is permitted through the connecting passages 91 and the first passage 50. The speed of reciprocation of the main valve 44 is increased as the cross-sectional area of the connecting passages 91 increases. With the provision of the connecting passages 91, an amount of consumption of the compressed air is considerably reduced.

Figure 21:
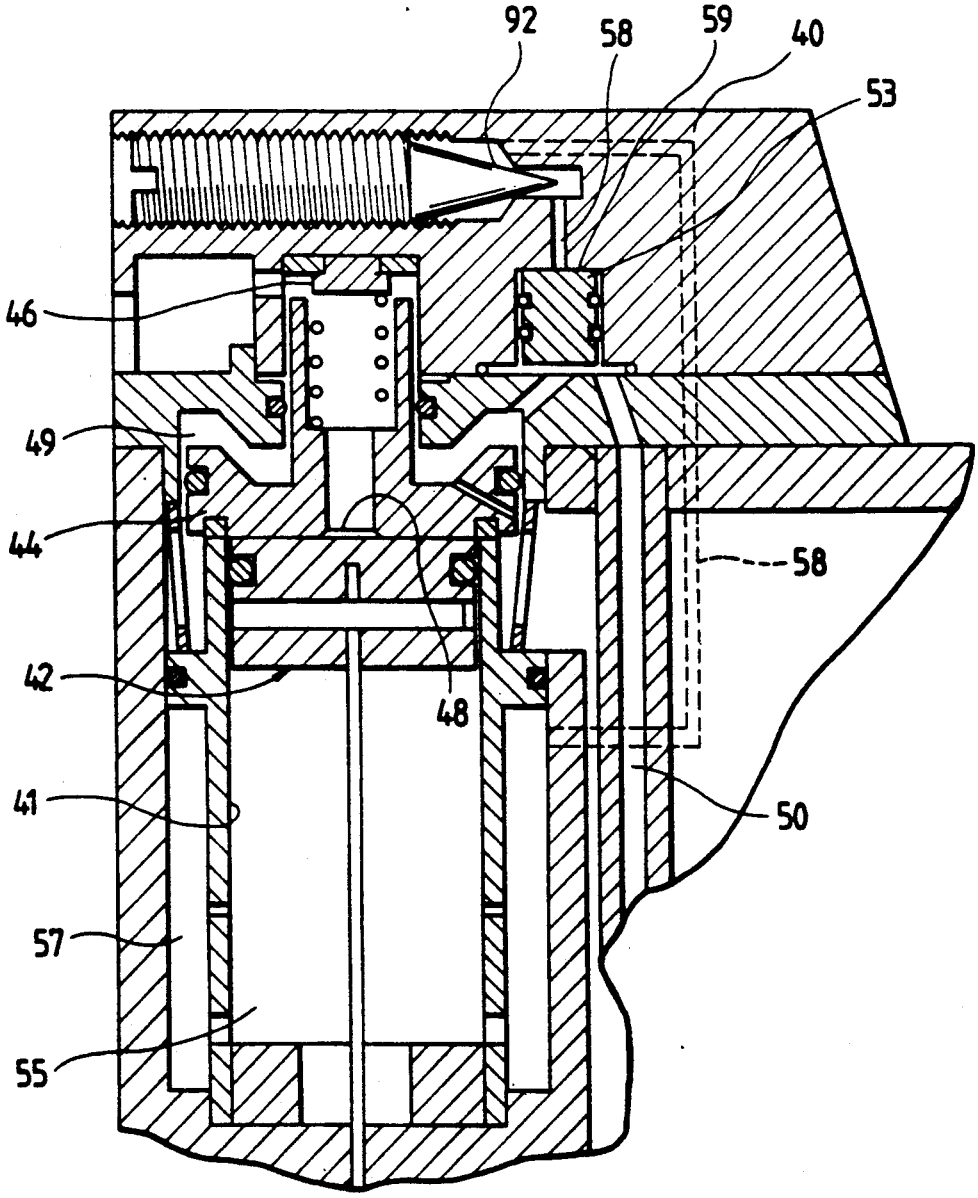
FIG. 21 is a fragmentary cross-sectional view of a modified fastener driving tool including an automatic repeated striking mechanism having an adjustable throttling valve.

FIG. 21 shows a main part of a modified fastener driving tool according to the present invention. The fastener driving tool is similar to the prior fastener driving tool shown in FIG. 29 but differs therefrom in that the repeat valve chamber 59 is connected not to the discharge valve 46 but to a return air chamber 57 through a third passage 58, with an adjustable throttling valve 92 disposed in the third passage 58 at a position between the repeat valve chamber 59 and the return air chamber 57. The operation of the illustrated fastener driving tool is substantially the same as that of the fastener driving tool shown in FIG. 2 and hence a description is no longer necessary.

Figure 22:
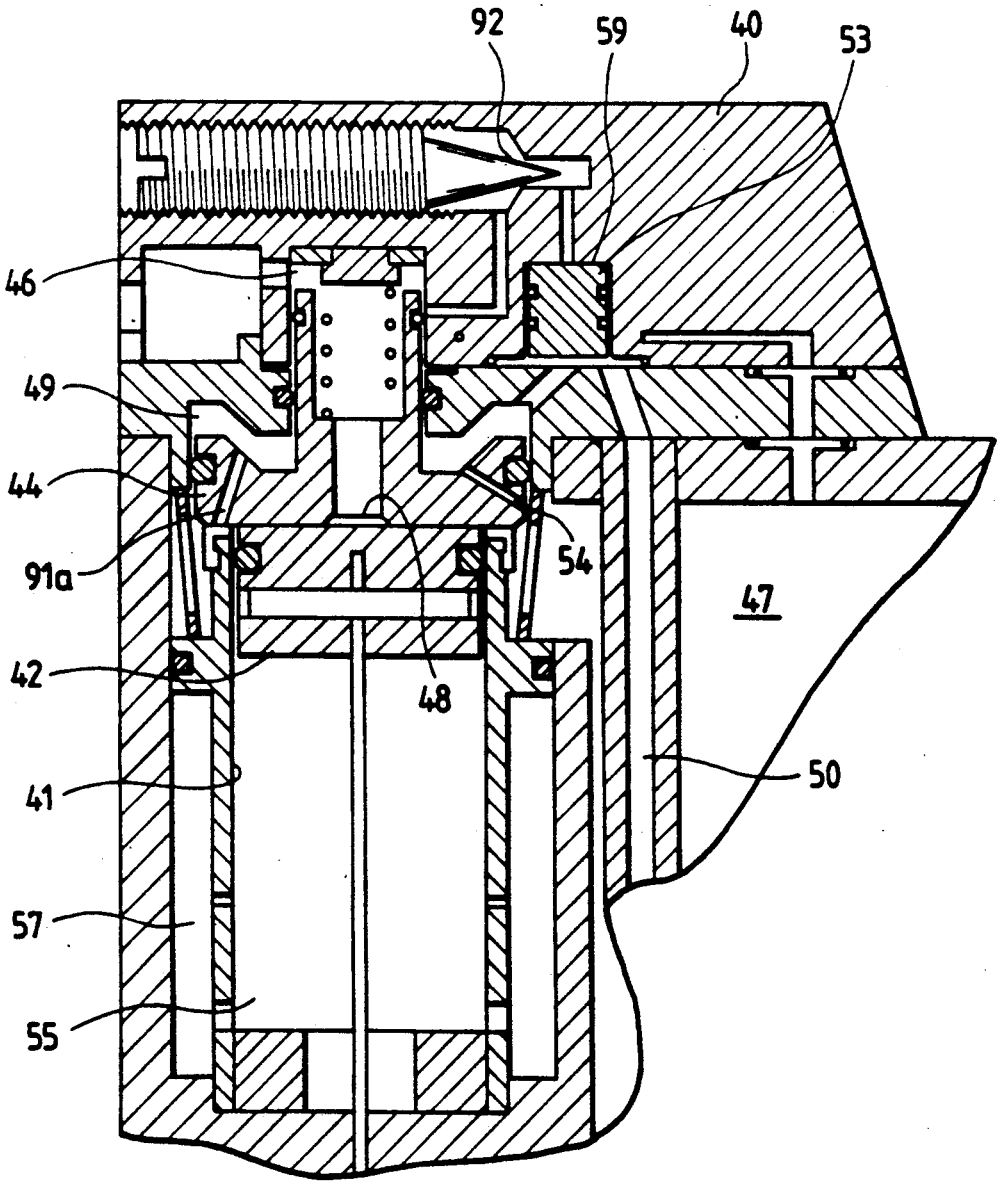
FIG. 22 is a view similar to FIG. 21, but showing a further modified form of the fastener driving tool.

Another modified fastener driving tool shown in FIG. 22 is substantially the same as the conventional fastener driving tool shown in FIG. 29 excepting that the main valve 44 has a connecting passage **91*a* interconnecting the accumulator 47 and the main valve chamber 49. The arrangement and operation of the connecting passage 91*a* is substantially the same as that of the connecting passages 91 illustrated in FIGS. 17** and hence a description is not necessary.

Figure 23:
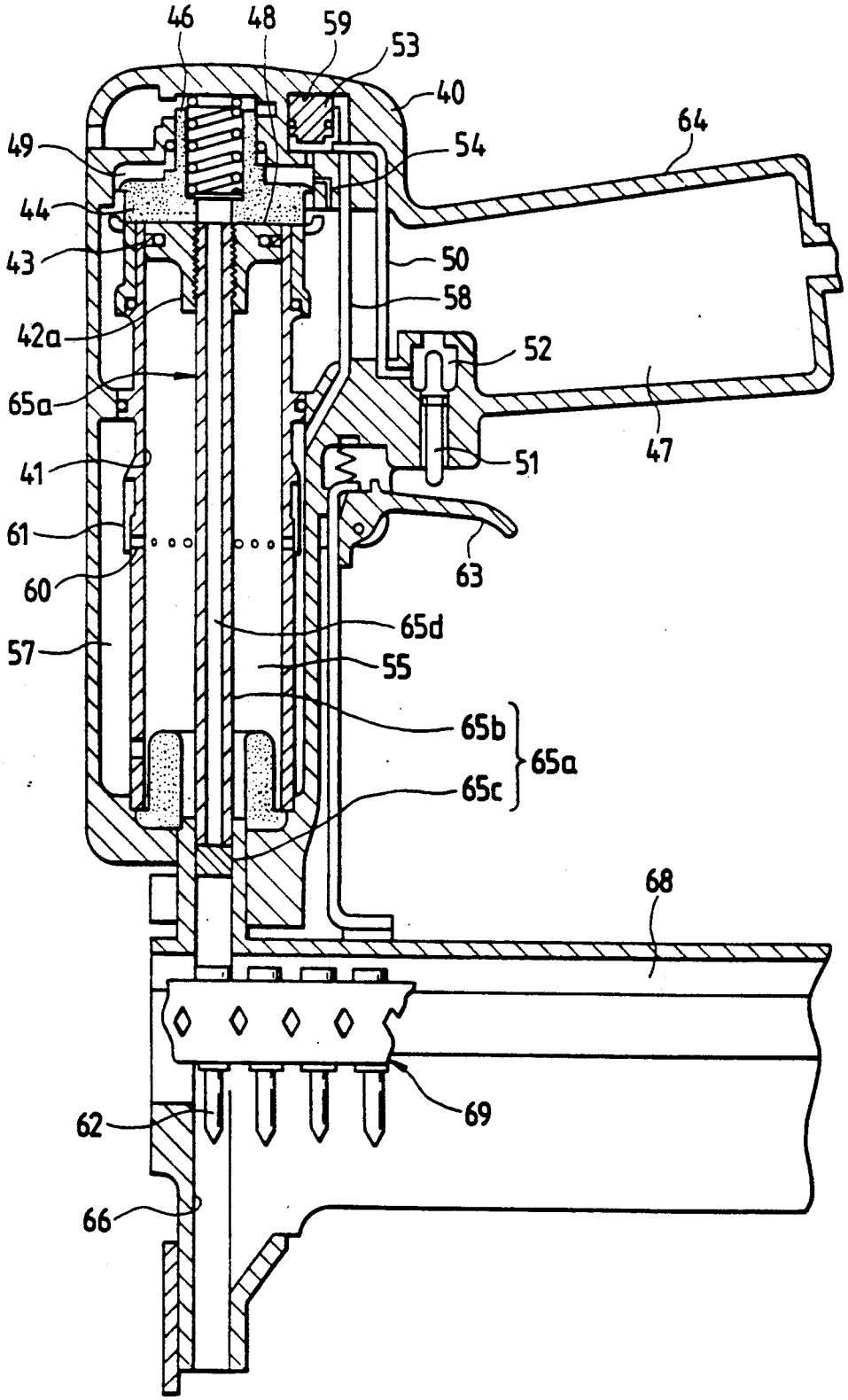
FIGS. 23 through 25 are views similar to FIGS. 2, 10 and 11, respectively, but showing a modified fastener driving tool according to the present invention.

FIG. 23 shows a modified fastener driving tool which is similar to the fastener driving tool shown in FIG. 2 but differs therefrom in the material and construction of a driving piston assembly composed of a piston **42*a* and a driving rod 65*a*. The piston 42*a* is formed of a light and rigid material such as light alloy, synthetic resin, hard synthetic rubber or the like. The driving rod 65***a* is made of metal and connected at its one end (upper end) to the center of the piston 42*a*. The driving rod 65*a* is composed of an elongate tubular body 65*b* firmly connected at its one end to the piston 42*a*, and a circular disk 65*c* attached by welding or brazing to the opposite end of the tubular body 65*b*. The driving rod 65*a* thus constructed has an axial blind hole 65*d* extending from the upper end along a longitudinal central axis of the driving rod 65*a* and terminating short of the lower end of the driving rod 65*a*. Since the blind hole 65*d* is defined in alignment with the longitudinal axis of the driving rod 65*a*, reduction of the bending strength of the driving rod 65*a* resulted from the provision of this blind hole 65*a* is not substantial. Owing to the light and rigid material constituting the piston 42*a* and also owing to the blind hole 65*d* defined longitudinally in the driving rod 65*a*, the driving piston assembly is considerably smaller in weight than the driving piston assembly according to any one of the foregoing embodiments. Such a large weight reduction results in a reduction of the reaction of the fastener driving tool being driven. This is because the magnitude of reaction of the fastener driving tool is nearly directly proportional to the weight of the driving piston assembly and is nearly inverse proportional to the weight of the tool body 40. With this reduction of the reaction force, the fastener driving operation can be achieved safely with utmost ease.

Figure 24:
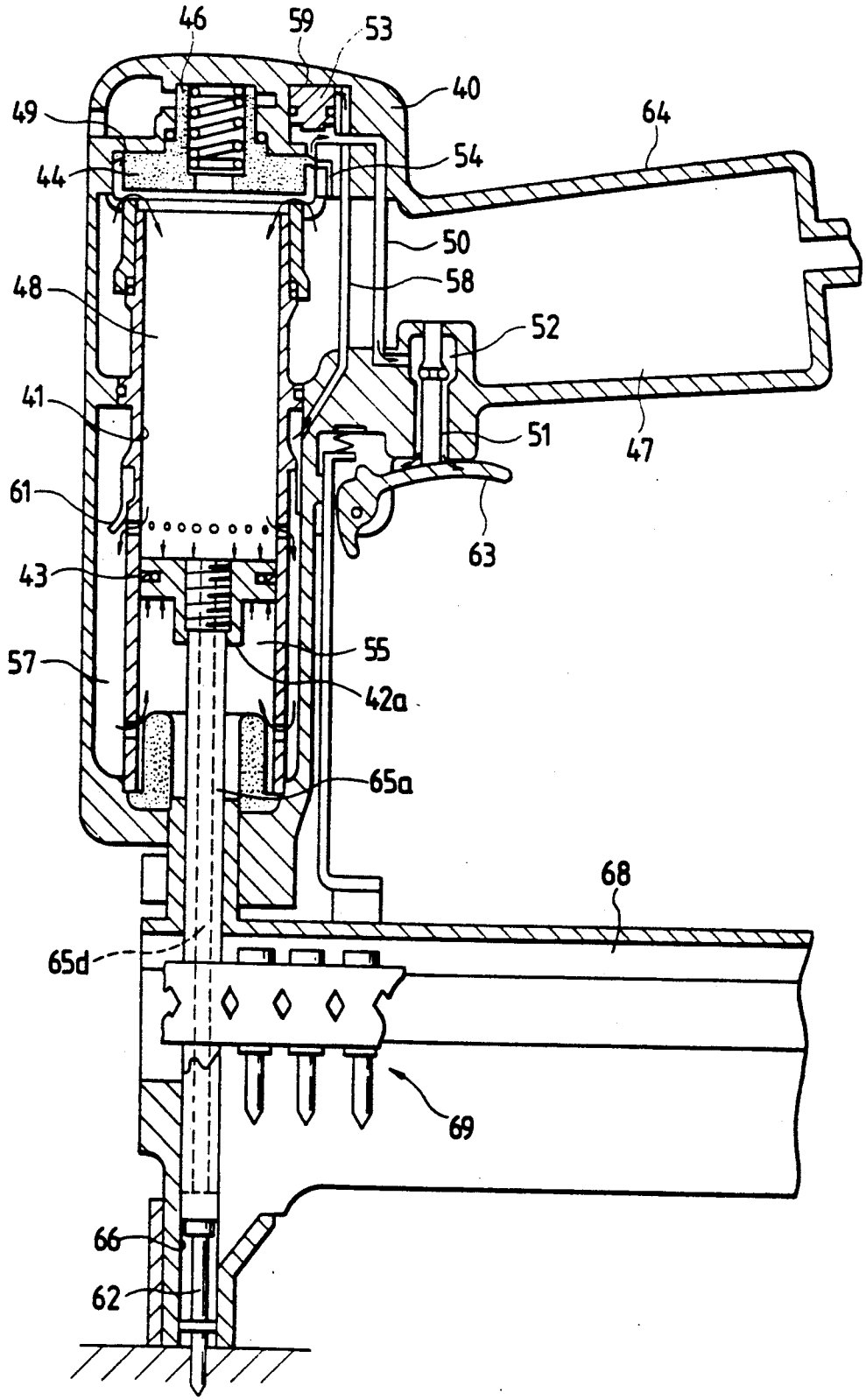
Figure 25:
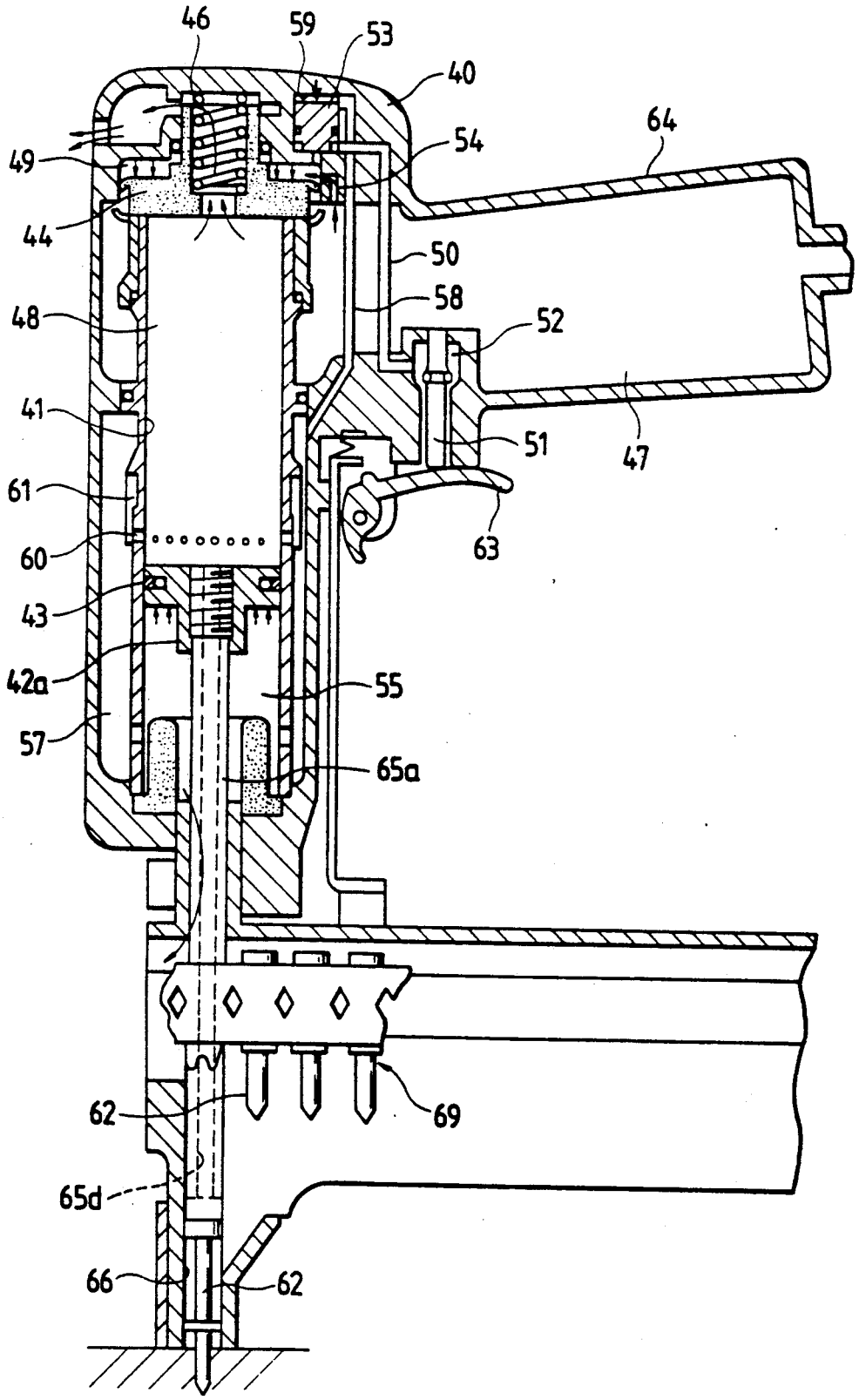

FIGS. 24 and 25 are cross-sectional views illustrative of the operation of the fastener driving tool shown in FIG. 23. The operation of this fastener driving tool is the same as the operation of the fastener driving tool shown in FIG. 2 and hence a description is no longer necessary.

Figure 26:
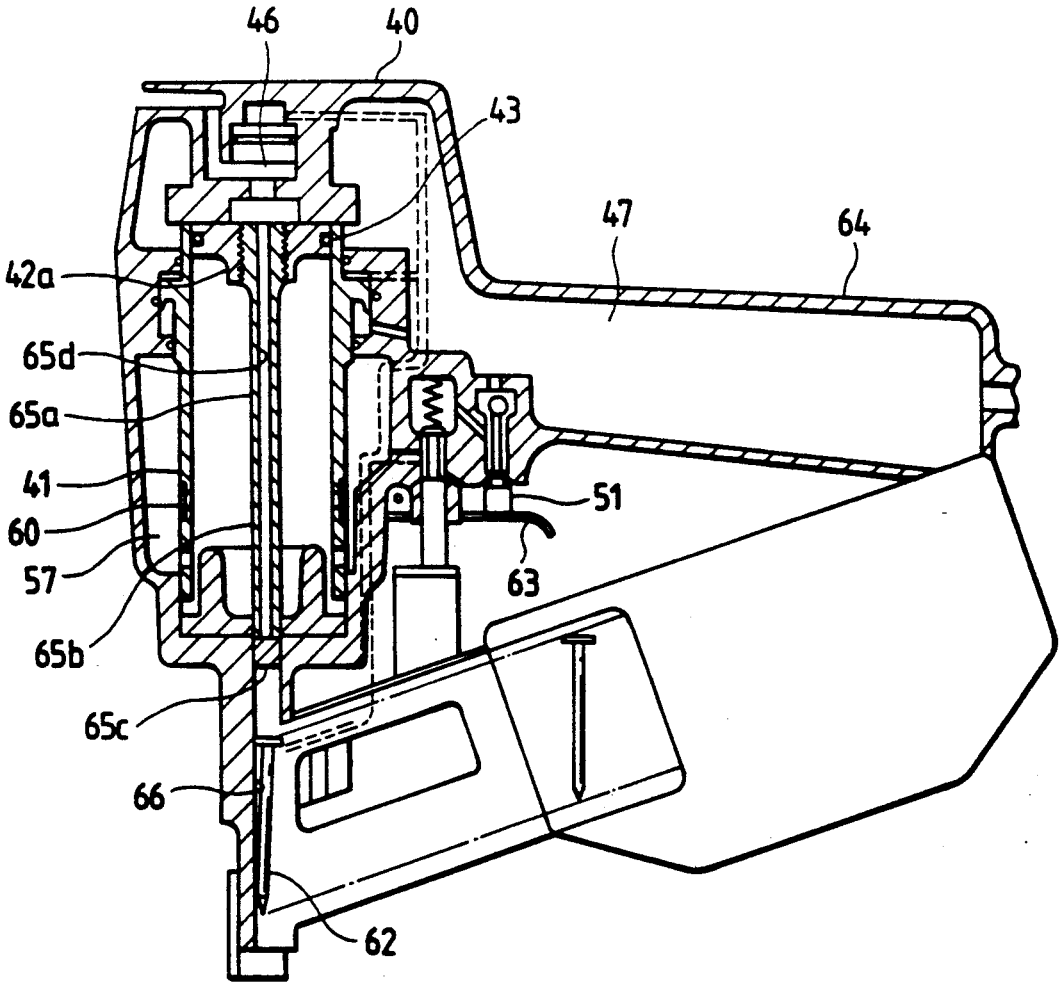
FIG. 26 is a longitudinal cross-sectional view of a fastener driving tool according to another embodiment of the present invention.
Figure 27:
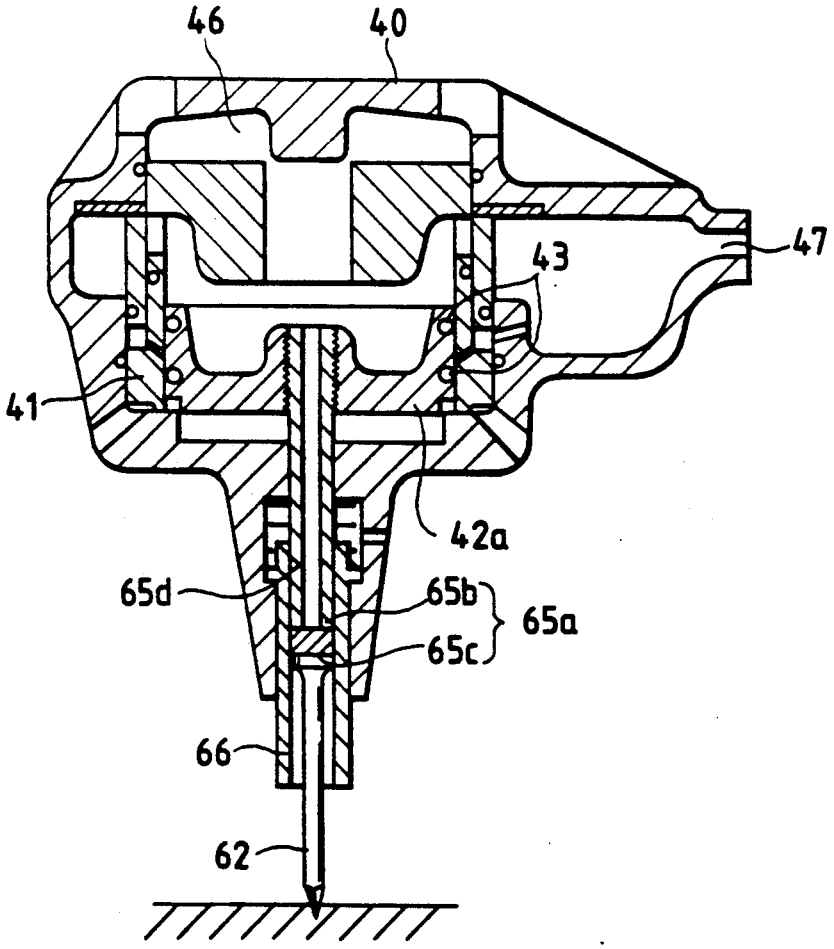
FIG. 27 is a view similar to FIG. 26, but showing a fastener driving tool according to a further embodiment of the invention.
Figure 28:
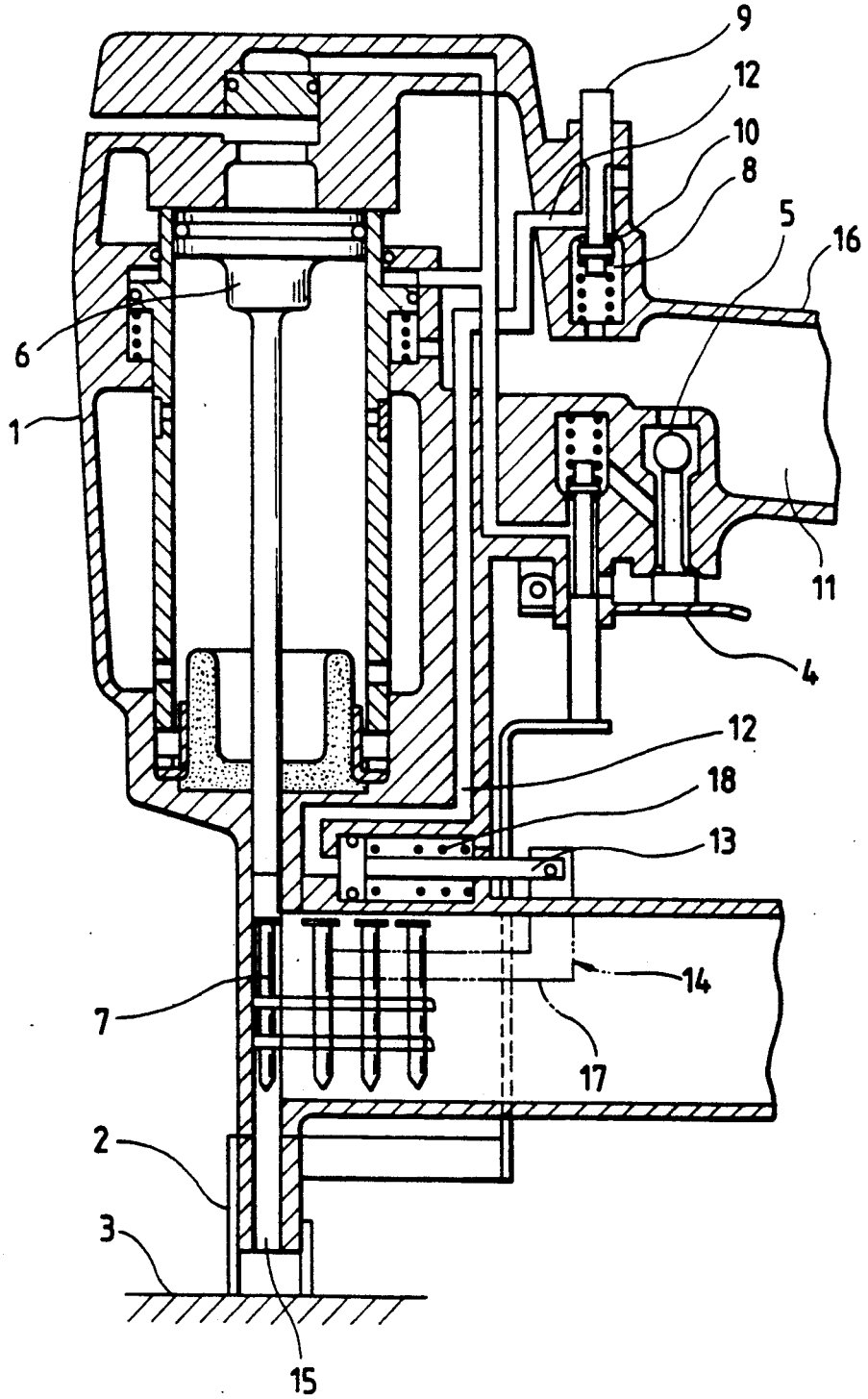
FIG. 28 PRIOR ART
FIG. 28 is a longitudinal cross-sectional view of a conventional pneumatic fastener driving tool.

FIGS. 26 and 27 show two modified forms of the fastener driving tool each of which has a lightweight driving piston assembly composed of a piston 42*a* formed of a light and rigid material and a driving rod 65*a* having a blind axial holes 65*d*. Owing to the lightweight driving piston assembly, the reaction created during the operation of the fastener driving tool is relatively small.

Obviously, various minor changes and modifications of the present invention are possible in the light of the above teaching. It is therefore to be understood that within the scope of the appended claims the invention may be practiced otherwise than as specifically described.

What is claimed is:

1. A pneumatic fastener driving tool comprising:

(a) a tool body having an internal accumulator for storing compressed air and a barrel along which a fastener is driven;

(b) a cylinder disposed in said tool body and extending in alignment with said barrel;

(c) a drive piston assembly including a piston slidably received in said cylinder, and a driving rod extending perpendicularly from the center of said piston and slidably received in said barrel, said cylinder and said piston jointly defining upper and lower piston chambers on opposite sides of said piston;

(d) a main valve chamber defined in said tool body and slidably holding therein a main valve, said main valve being externally operable for causing the compressed air to be alternately introduced from said accumulator into said upper piston chamber and discharged from said main valve chamber to the outside air;

(e) a first passage defined in said tool body and extending between said accumulator and said main valve chamber for leading the compressed air into said main valve chamber, said piston being driven to reciprocate said driving rod when the compressed air is discharged from said main valve chamber via said first passage;

(f) a trigger mounted on said tool body and manually actuatable for controlling operation of said main valve;

(g) a repeat valve disposed in said first passage for opening and closing the same;

(h) a second passage defined in said tool body and extending between said lower piston chamber and a repeat valve chamber in which said repeat valve is reciprocably received, said repeat valve being reciprocally movable in response to a change of pressure in said lower piston chamber to cause said main valve to reciprocate, thereby reciprocating said piston repeatedly; and (i) a fastener supply unit mounted on said tool body for feeding fasteners one at a time to said barrel.

2. A pneumatic fastener driving tool according to claim 1, further including a throttling valve disposed in said second passage.

3. A pneumatic fastener driving tool according to claim 1, further including a connecting passage extending between said main valve chamber and said accumulator and adapted to be opened and closed in response to the reciprocating movement of said main valve, said connecting passage being closed when said main valve is disposed at its bottom dead center.

4. A pneumatic fastener driving tool according to claim 3, wherein said main valve is disposed above said cylinder and is engageable with an upper end of said cylinder to close same when it is disposed at said bottom dead center, said connecting passage extending across the thickness of said main valve and having one end closed by said upper end of said cylinder when said main valve is disposed in its bottom dead center.

5. A pneumatic fastener driving tool according to claim 1, wherein said tool body has a handle for being gripped by a user's hand, said trigger being disposed adjacent to the base of said handle, said fastener supply unit including a feed valve disposed in said tool body for controlling the operation of said fastener supply unit, and an actuator manually operable from the outside of said tool body to control the operation of said feed valve, said actuator being disposed adjacent to said trigger and manually operable with a finger of said user's hand gripping said handle with the same hand.

6. A pneumatic fastener driving tool according to claim 5, wherein said fastener supply unit further includes an additional feed valve operatively connected with said fastener supply unit for controlling the operation of the same, and an additional actuator manually operable from the outside of said tool body to control the operation of said feed valve, said actuator and said additional actuator being disposed on opposite sides of said tool body in symmetric relation with respect to a central plane of said handle.

7. A pneumatic fastener driving tool according to claim 5, wherein said first passage communicates with said accumulator via a control valve adapted to be actuated by said trigger for controlling the operation of said main valve, said fastener supply unit further having a compressed air supply passage extending from said fastener supply unit to said first passage and communicating with said control valve, said feed valve being disposed in said compressed air supply passage.

8. A pneumatic fastener driving tool according to claim 1, for use with a fastener strip including a continuous feed belt having a plurality of guide holes longitudinally spaced at equal intervals, and a succession of laterally spaced fasteners supported on said feed belt at equal intervals, wherein said fastener supply unit includes a guide groove extending perpendicularly across said barrel for the passage of said feed belt, a feed piston disposed parallel to said guide groove and reciprocally movable under the control of said feed valve between an advanced position adjacent to said barrel and a retracted position remote from said barrel, said feed piston being normally urged to said retracted position, and a feed prong engageable with one of said guide holes and driven by said feed piston to advance the fastener strip for feeding the leading fastener to said barrel.

9. A pneumatic fastener driving tool according to claim 8, further including a spring acting on said feed piston and urging said feed piston toward said retracted position.

10. A pneumatic fastener driving tool according to claim 8, wherein said feed prong is connected to said feed piston and extends transverse to said guide groove, said feed prong partly projecting into said guide groove for engagement with the guide holes in the feed belt.

11. A pneumatic fastener driving tool according to claim 8, wherein said feed prong normally projects into said guide groove and is retractable from said guide groove as said feed piston moves from said advanced position to said retracted position, said feed prong having an inclined rear surface frictionally engageable with an edge of the guide hole to cause said feed prong to retract away from said guide groove.

12. A pneumatic fastener driving tool according to claim 11, wherein said feed prong is slidably mounted on said feed piston and urged by a spring to project into said guide groove.

13. A pneumatic fastener driving tool according to claim 8, wherein said feed piston and said feed prong are relatively movable in a direction parallel to the axis of said guide groove, and a first spring is disposed between said feed piston and said feed prong.

14. A pneumatic fastener driving tool according to claim 13, further including a second spring acting on said feed piston and urging the feed piston toward said retracted position, said first spring having a spring force greater than that of said second spring.

15. A pneumatic fastener driving tool according to claim 13, wherein said piston has a hollow cylindrical shape and slidably receives therein a slider, and a third spring is provided to act between said slider and said feed piston and urge said slider toward said advanced position, and said feed prong is mounted on said slider.

16. A pneumatic fastener driving tool according to claim 15, further including a fourth spring acting between said slider and said feed prong and urging the latter to project into said guide groove, said feed prong having an inclined rear surface facing away from said barrel and frictionally engageable with an edge of the guide hole in the feed belt.

17. A pneumatic fastener driving tool according to claim 1, wherein said piston is formed of light rigid material, and said driving rod is made of a metal and has an axial blind hole extending from an end of the driving rod which is connected to said piston.

18. A pneumatic fastener driving tool according to claim 17, wherein said driving rod includes an elongate tubular body connected at one end to said piston, and a circular disk joined with the opposite end of said tubular body to close the same.

19. A pneumatic fastener driving tool according to claim 17, wherein said piston is formed of a synthetic resin.

20. A pneumatic fastener driving tool according to claim 17, wherein said piston is formed of a light alloy.

21. A pneumatic fastener driving tool according to claim 17, wherein said piston is formed of rigid synthetic rubber.

* * * * *